US010548441B2

(12) United States Patent
Wang et al.

(10) Patent No.: US 10,548,441 B2
(45) Date of Patent: Feb. 4, 2020

(54) VACUUM CLEANER

(71) Applicant: JIANGSU MIDEA CLEANING APPLIANCES CO., LTD., Suzhou (CN)

(72) Inventors: Xinzhou Wang, Suzhou (CN); Yonghua Wang, Suzhou (CN); Min Zhong, Suzhou (CN)

(73) Assignee: JIANGSU MIDEA CLEANING APPLIANCES CO., LTD., Suzhou (CN)

( * ) Notice: Subject to any disclaimer, the term of this patent is extended or adjusted under 35 U.S.C. 154(b) by 0 days.

(21) Appl. No.: 15/539,161

(22) PCT Filed: Mar. 22, 2016

(86) PCT No.: PCT/CN2016/077008
§ 371 (c)(1),
(2) Date: Jun. 23, 2017

(87) PCT Pub. No.: WO2017/124631
PCT Pub. Date: Jul. 27, 2017

(65) Prior Publication Data

US 2018/0333019 A1 Nov. 22, 2018

(30) Foreign Application Priority Data

Jan. 20, 2016 (CN) ..... 2016 1 0036809
Jan. 20, 2016 (CN) ..... 2016 1 0037162
(Continued)

(51) Int. Cl.
*A47L 5/12* (2006.01)
*A47L 9/12* (2006.01)
(Continued)

(52) U.S. Cl.
CPC ..... *A47L 5/12* (2013.01); *A47L 5/225* (2013.01); *A47L 5/24* (2013.01); *A47L 7/0071* (2013.01);
(Continued)

(58) Field of Classification Search
CPC ... A47L 5/12; A47L 5/225; A47L 5/24; A47L 7/0071; A47L 9/102; A47L 9/12;
(Continued)

(56) References Cited

U.S. PATENT DOCUMENTS 5,850,667 A * 12/1998 Orsini ..... A47L 9/32 15/339
8,069,529 B2 * 12/2011 Groff ..... A47L 5/24 15/344
(Continued)

FOREIGN PATENT DOCUMENTS

CN 2446949 Y * 9/2001
CN 2446949 Y 9/2001
(Continued)

OTHER PUBLICATIONS

European office action dated Jan. 24, 2018 in the corresponding European Application(application No. 16874086.8).
(Continued)

*Primary Examiner* — Marc Carlson
(74) *Attorney, Agent, or Firm* — Kilpatrick Townsend & Stockton, LLP

(57) ABSTRACT

A vacuum cleaner (100) is provided. The vacuum cleaner (100) includes a hand-held device (400), and the hand-held device includes: a housing (401); a dust cup (402) disposed in the housing (401) and having a dust outlet in a bottom thereof; and an ash pouring plate (405) disposed at a bottom of the housing (401. The ash pouring plate (405) is config-
(Continued)

ured to be movable between an open position for opening the dust outlet and a closed position for closing the dust outlet.

27 Claims, 30 Drawing Sheets

(30) Foreign Application Priority Data

| | | |
|---|---|---|
| Jan. 20, 2016 | (CN) | 2016 1 0037164 |
| Jan. 20, 2016 | (CN) | 2016 2 0053970 U |
| Jan. 20, 2016 | (CN) | 2016 2 0054591 U |
| Jan. 20, 2016 | (CN) | 2016 2 0054836 U |
| Mar. 7, 2016 | (CN) | 2016 1 0127643 |
| Mar. 7, 2016 | (CN) | 2016 2 0171694 U |

(51) Int. Cl.

| | |
|---|---|
| ***A47L 9/32*** | (2006.01) |
| ***A47L 5/24*** | (2006.01) |
| ***A47L 9/16*** | (2006.01) |
| ***A47L 9/10*** | (2006.01) |
| ***A47L 5/22*** | (2006.01) |
| ***A47L 9/14*** | (2006.01) |
| ***A47L 7/00*** | (2006.01) |

(52) U.S. Cl.
CPC ..... *A47L 9/102* (2013.01); *A47L 9/12* (2013.01); *A47L 9/149* (2013.01); *A47L 9/165* (2013.01); *A47L 9/1633* (2013.01); *A47L 9/32* (2013.01); *A47L 9/322* (2013.01)

(58) Field of Classification Search
CPC ..... A47L 9/149; A47L 9/1633; A47L 9/165; A47L 9/32; A47L 9/322
See application file for complete search history.

(56) References Cited

U.S. PATENT DOCUMENTS

| | | | | |
|---|---|---|---|---|
| 2003/0037403 | A1* | 2/2003 | Lang | A47L 5/24 15/330 |
| 2005/0125944 | A1* | 6/2005 | Ji | A47L 9/325 15/410 |
| 2005/0229355 | A1 | 10/2005 | Crouch et al. | |
| 2005/0252180 | A1* | 11/2005 | Oh | A47L 9/1625 55/345 |
| 2007/0079473 | A1 | 4/2007 | Min et al. | |
| 2008/0022483 | A1* | 1/2008 | Potoroka | A47L 9/325 15/340.2 |
| 2008/0040883 | A1* | 2/2008 | Beskow | A47L 5/225 15/329 |
| 2009/0241285 | A1* | 10/2009 | Hinklin | A47L 5/14 15/330 |
| 2010/0115726 | A1* | 5/2010 | Groff | A47L 5/24 15/344 |
| 2010/0251506 | A1* | 10/2010 | Conrad | A47L 5/225 15/344 |
| 2011/0219557 | A1* | 9/2011 | Rosenzweig | A47L 5/28 15/144.1 |
| 2011/0289719 | A1* | 12/2011 | Han | A47L 5/225 15/344 |
| 2012/0266576 | A1* | 10/2012 | Gomiciaga-Pereda | A47L 5/24 55/343 |
| 2013/0133146 | A1* | 5/2013 | Brueckner | A47L 11/125 15/21.1 |
| 2015/0307066 | A1 | 10/2015 | Camiller | |
| 2016/0037984 | A1* | 2/2016 | Park | A47L 9/0081 15/326 |
| 2016/0106285 | A1* | 4/2016 | Jenson | A47L 9/0477 29/426.1 |
| 2016/0143498 | A1* | 5/2016 | Gu | A47L 9/1616 55/322 |
| 2016/0174787 | A1* | 6/2016 | Conrad | A47L 5/24 15/329 |
| 2017/0071426 | A1* | 3/2017 | Krebs | A47L 9/322 |
| 2017/0296006 | A1* | 10/2017 | Wang | A47L 9/1683 |

FOREIGN PATENT DOCUMENTS

| | | | | | |
|---|---|---|---|---|---|
| CN | 1695538 | A | | 11/2005 | |
| CN | 2776272 | Y | | 5/2006 | |
| CN | 101437435 | A | | 5/2009 | |
| CN | 201658325 | U | | 12/2010 | |
| CN | 102755135 | A | | 10/2012 | |
| CN | 101982154 | B | * | 12/2012 | |
| CN | 103037747 | A | | 4/2013 | |
| CN | 104274121 | A | | 1/2015 | |
| CN | 104274121 | A | * | 1/2015 | A47L 5/24 |
| CN | 105054864 | A | | 11/2015 | |
| CN | 205359366 | U | | 7/2016 | |
| CN | 205433556 | U | | 8/2016 | |
| CN | 205458420 | U | | 8/2016 | |
| CN | 205514360 | U | | 8/2016 | |
| DE | 202015103964 | U1 | * | 10/2015 | A47L 5/225 |
| EP | 1692992 | A1 | | 8/2006 | |
| GB | 2448915 | A | | 11/2008 | |
| JP | 200041926 | A | | 2/2000 | |
| JP | 2000107100 | A | * | 4/2000 | |
| JP | 3177444 | B2 | * | 6/2001 | |
| JP | 2003061878 | A | * | 3/2003 | |
| JP | 2003061883 | A | * | 3/2003 | |
| JP | 2008220898 | A | | 9/2008 | |
| JP | 2012090762 | A | * | 5/2012 | |
| WO | WO-2008039127 | A1 | * | 4/2008 | A47L 5/24 |
| WO | WO-2014091392 | A1 | * | 6/2014 | A47L 5/30 |
| WO | WO-2016061521 | A1 | * | 4/2016 | A47L 9/0477 |

OTHER PUBLICATIONS

Chinese office action dated Jul. 28, 2017 in the corresponding Chinese application(application No. 201610036809.9).
Chinese office action dated Aug. 9, 2017 in the corresponding Chinese application(application No. 201610037162.1).
Chinese office action dated Aug. 23, 2017 in the corresponding Chinese application(application No. 201610037164.0).

* cited by examiner

F-F

G–G

VACUUM CLEANER

CROSS REFERENCE TO RELATED APPLICATION

The present application is a National Stage of International Application No. PCT/CN2016/077008, filed Mar. 22, 2016, which claims the priority and benefit of Chinese Patent Application No. 201610037164.0, 201620054836.4, 201610036809.9, 201620054591.5, 201610037162.1, 201620053970.2, all filed on Jan. 20, 2016, and 201610127643.1 and 201620171694.X, both filed on Mar. 7, 2016, the contents of which are incorporated herein by reference in their entirety.

FIELD

Embodiments of the present disclosure generally relate to a vacuum cleaner technical field, and more particularly, to a vacuum cleaner.

BACKGROUND

In the related art, a dust cup is usually required to be removed from a housing of a hand-held vacuum cleaner in order to pour ash, and the whole ash pouring process is complex. Moreover, the dust cup is required to be remounted to the housing after the completion of the ash pouring, and thus the whole ash pouring process takes a lot of time.

SUMMARY

Embodiments of the present disclosure seek to solve at least one of the problems existing in the related art to at least some extent. Accordingly, an objective of the present disclosure is to provide a vacuum cleaner, which can be conveniently used and packaged.

The vacuum cleaner according to embodiments of the present disclosure includes a hand-held device. The hand-held device includes: a housing; a dust cup disposed in the housing and having a dust outlet in a bottom thereof; and an ash pouring plate disposed at a bottom of the housing, in which the ash pouring plate is configured to be movable between an open position for opening the dust outlet and a closed position for closing the dust outlet.

With the vacuum cleaner according to embodiments of the present disclosure, by providing the above ash pouring plate, dirt and dust in the dust cup can be conveniently poured out, such that the ash pouring process is greatly simplified.

According to an embodiment of the present disclosure, a first end of the ash pouring plate is pivotably connected to the housing so that the ash pouring plate is rotatable between the open position and the closed position, and a second end of the ash pouring plate is configured to be separably fitted with the housing.

According to an embodiment of the present disclosure, the second end of the ash pouring plate is configured to be separably fitted with the housing via at least one fitting structure, and the fitting structure includes a first fitting member disposed at the second end of the ash pouring plate, and a second fitting member disposed at the housing, when the ash pouring plate is in the open position, the first fitting member is separated from the second fitting member, in which when the ash pouring plate is in the closed position, the first fitting member is fitted with the second fitting member.

According to an embodiment of the present disclosure, the first fitting member and the second fitting member are configured as snaps configured to be buckled with each other.

According to an embodiment of the present disclosure, the vacuum cleaner further includes: a press button disposed in the housing, in which the second fitting member is disposed on the press button, and when the press button is pressed down, the second fitting member moves away from the first fitting member so as to be separated from the first fitting member.

According to an embodiment of the present disclosure, an elastic element is provided between the press button and the dust cup, and configured to constantly push the press button in a direction running away from a center of the housing.

According to an embodiment of the present disclosure, the elastic element is configured as a spring.

According to an embodiment of the present disclosure, two fitting structures are provided, and the two fitting structures are bilaterally symmetrical.

According to an embodiment of the present disclosure, the ash pouring plate extends in a front and rear direction, and a rear end of the ash pouring plate is pivotably connected to the housing.

According to an embodiment of the present disclosure, a sealing member is disposed between the ash pouring plate and the dust outlet so as to seal a gap between the ash pouring plate and the dust outlet.

According to an embodiment of the present disclosure, the dust cup includes a first cyclone provided with an air intake channel, the air intake channel having a first air intake port and a first air outtake port; a cyclone assembly including a plurality of second cyclones arranged in parallel along a circumferential direction of the first cyclone, two of the plurality of second cyclones defining a guiding channel therebetween, the guiding channel communicating with the first air outtake port and guiding the airflow to an outer periphery of the cyclone assembly along a tangent line of a circumferential wall of one second cyclone adjacent to the guiding channel, each second cyclone having an air inducing notch so that the airflow enters the second cyclone along a tangent direction, an air guiding pipe being provided in each second cyclone and spaced apart from an inner circumferential wall of the second cyclone, the air guiding pipe having an air guiding inlet and an air guiding outlet, and the air guiding inlet communicating with the air inducing notch; and a filter disposed along the outer periphery of the cyclone assembly, the airflow at the outer periphery of the cyclone assembly tangentially flowing into the second cyclone through the filter and the air inducing notch.

According to an embodiment of the present disclosure, the air guiding pipe is eccentrically disposed with respect to the second cyclone.

According to an embodiment of the present disclosure, the air guiding pipe extends in a vertical direction.

According to an embodiment of the present disclosure, the air guiding pipe has a partition plate therein.

According to an embodiment of the present disclosure, the air guiding pipe is located in an upper portion of the second cyclone.

According to an embodiment of the present disclosure, the air guiding inlet is provided at a lower end of the air guiding pipe, and the air guiding outlet is provided at an upper end of the air guiding pipe.

According to an embodiment of the present disclosure, the filter is arranged around the cyclone assembly and has a relief opening therein, and the relief opening is opposed to the guiding channel.

According to an embodiment of the present disclosure, a connecting wall is connected to a first side of the air inducing notch of each second cyclone, in which the connecting wall is tangent to a side wall of the second cyclone, and an extending part extends out from a second side of the air inducing notch of the second cyclone, and the extending part and the connecting wall define a tangential air inducing channel therebetween.

According to an embodiment of the present disclosure, the extending part extends towards a corresponding connecting wall along a flowing direction of the airflow.

According to an embodiment of the present disclosure, an inner wall of an end of the air intake channel has a guiding surface configured to guide the airflow in the air intake channel to the guiding channel, wherein the first air outtake port is provided at the end of the air intake channel.

According to an embodiment of the present disclosure, the guiding surface is configured as an arc surface.

According to an embodiment of the present disclosure, the guiding channel is configured to have a width gradually increased along a flowing direction of the airflow.

According to an embodiment of the present disclosure, each second cyclone has an opening in a bottom thereof.

According to an embodiment of the present disclosure, the filter is configured as a filter net or an insert having filtering holes.

According to an embodiment of the present disclosure, the vacuum cleaner further includes: a machine body; and a handle disposed on the machine body and pivotable between a first position and a second position, wherein the handle is located at a front side of the machine body when the handle is in the first position, and the handle is located at a rear side of the machine body when the handle is in the second position.

According to an embodiment of the present disclosure, at least one lock catch assembly is disposed between the machine body and the handle, and is configured to be movable between a locking position for locking the handle and a pivoting position for making the handle pivotable between the first position and the second position.

According to an embodiment of the present disclosure, each lock catch assembly includes: a retainer disposed at the machine body; and a lock catch disposed at the handle and configured to be separably fitted with the retainer, wherein the lock catch is fitted with the retainer when the lock catch assembly is in the locking position, and the lock catch is separated from the retainer when the lock catch assembly is in the pivoting position.

According to an embodiment of the present disclosure, one of the lock catch and the retainer is provided with a fitting part, the other one of the lock catch and the retainer is provided with a fitting groove, and the fitting part is configured to be separably fitted with the fitting groove.

According to an embodiment of the present disclosure, the fitting part includes a plurality of fitting teeth arranged in a circumferential direction of the one of the lock catch and the retainer and spaced from one another, the fitting groove includes a plurality of sub fitting grooves arranged in a circumferential direction of the other one of the lock catch and the retainer and spaced from one another, and the plurality of fitting teeth is configured to be separably fitted with the plurality of sub fitting grooves.

According to an embodiment of the present disclosure, one of a surface of the lock catch and a surface of the retainer opposite to each other is provided with a guiding post, the other one of the surface of the lock catch and the surface of the retainer opposite to each other is provided with a guiding hole, and the fitting part is fitted with the fitting groove when the guiding post extends into the guiding hole.

According to an embodiment of the present disclosure, an end surface of a free end of the guiding post extends beyond a side surface of the fitting part adjacent to the retainer.

According to an embodiment of the present disclosure, the lock catch assembly further includes a pull rod movably disposed in the handle, and the pull rod is fitted with the lock catch so that the lock catch is configured to be separably fitted with the retainer.

According to an embodiment of the present disclosure, the pull rod is disposed within the handle and movable between a fixing position and a releasing position, a pull block is provided at an end of the pull rod adjacent to a center of the machine body, one of the pull block and the machine body is provided with a fixing protrusion, the other one of the pull block and the machine body is provided with a fixing groove, when the pull rod is in the fixing position, the fixing protrusion is fitted with the fixing groove, so that the handle is immovable with respect to the machine body, when the pull rod is in the releasing position, the fixing protrusion is separated from the fixing groove, so that the handle is forward and backward rotatable with respect to the machine body.

According to an embodiment of the present disclosure, the lock catch is fitted with the retainer when the pull rod is in the fixing position, and the lock catch is separated from the retainer when the pull rod is in the releasing position.

According to an embodiment of the present disclosure, the pull rod is connected with the pull block via a connecting structure, and the connecting structure includes: two ear plates disposed on the pull rod and spaced apart from each other, each ear plate having a connecting hole therein; and two connecting posts disposed on the pull block and spaced apart from each other, wherein the two connecting posts are configured to fit with the two connecting holes respectively so as to connect the pull block to the pull rod.

According to an embodiment of the present disclosure, the pull block is integral with the pull rod.

According to an embodiment of the present disclosure, the vacuum cleaner further includes: a first resetting member disposed between the retainer and the lock catch and configured to constantly push the lock catch in a direction running away from a center of the retainer; or a first resetting member disposed at a side of the lock catch away from the retainer and configured to constantly push the lock catch towards the retainer.

According to an embodiment of the present disclosure, the first resetting member is configured as a spring.

According to an embodiment of the present disclosure, the vacuum cleaner further includes: a second resetting member disposed within the handle and configured to constantly push the pull block towards the fixing position.

According to an embodiment of the present disclosure, the lock catch has a first inclined surface, the pull rod has a second inclined surface, and the second inclined surface is configured to fit with the first inclined surface so that the lock catch is configured to be separably fitted with the retainer.

According to an embodiment of the present disclosure, a positioning member is provided on an inner wall of the handle, and the lock catch is provided with a positioning groove configured to fit with the positioning member.

According to an embodiment of the present disclosure, two lock catch assemblies are provided and bilaterally symmetrical with respect to a center of a pivoting shaft.

According to an embodiment of the present disclosure, one of two lock catches of the two lock catch assemblies is provided with a circumferential position limiting protrusion, and the other one of the two lock catches of the two lock catch assemblies is provided with a circumferential position limiting groove.

According to an embodiment of the present disclosure, the handle is pivotably connected with the machine body via a pivoting shaft, and the lock catch assembly is penetrated by the pivoting shaft.

According to an embodiment of the present disclosure, the pivoting shaft includes a threaded fastener and at least one nut connected to a free end of the threaded fastener.

According to an embodiment of the present disclosure, when the pull rod moves to the releasing position from the fixing position, the pull rod moves in a direction running away from the center of the machine body and along a length direction of the handle.

According to an embodiment of the present disclosure, when the pull rod is in the fixing position, the handle is in a substantially upright state with respect to the machine body.

According to an embodiment of the present disclosure, the pull rod is provided with a pull rod button, an opening is formed in the handle and the pull rod button extends out of the handle through the opening.

Additional aspects and advantages of embodiments of the present disclosure will be given in part in the following descriptions, become apparent in part from the following descriptions, or be learned from the practice of the embodiments of the present disclosure.

BRIEF DESCRIPTION OF THE DRAWINGS

These and other aspects and advantages of embodiments of the present disclosure will become apparent and more readily appreciated from the following descriptions made with reference to the accompanying drawings, in which.

REFERENCE NUMERALS

Figure 1:
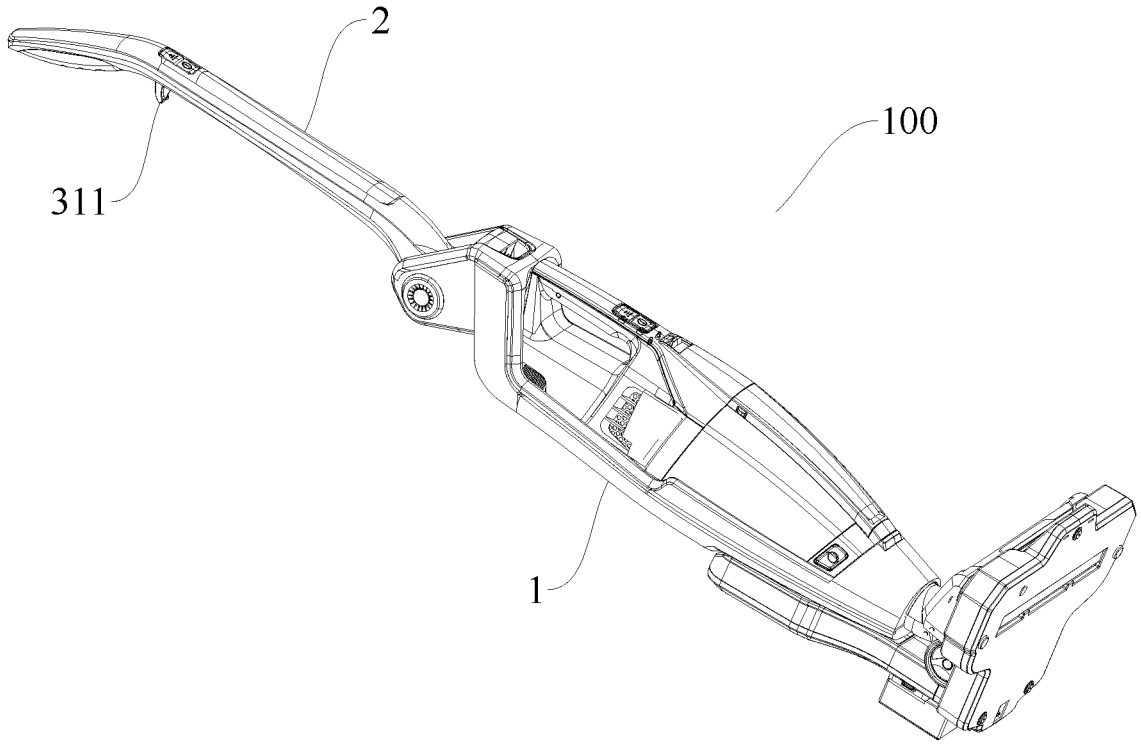
FIG. 1 is a perspective view of a vacuum cleaner according to an embodiment of the present disclosure.

100: vacuum cleaner;

1: machine body; 11: fixing groove;

2: handle; 21: opening; 22: pivoting shaft; 23: separating plate; 24: positioning member;

31: pull rod; 311: pull rod button; 312: ear plate; 3121: connecting hole;

32: pull block; 321: fixing protrusion; 322: second inclined surface; 323: connecting post; 324: second fitting block;
33: retainer; 331: sub fitting groove; 332: guiding hole; 333: mounting hole;
34: lock catch; 341: fitting tooth; 342: guiding post; 343: first inclined surface; 344: positioning groove;
345: first fitting block; 346: circumferential position limiting protrusion; 347: circumferential position limiting groove;
35: first resetting member;
361: bolt; 362: nut; 4: second resetting member.
400: hand-held device;
401: housing; 4011: air inlet pipe; 4012: air inlet;
4013: air blowing channel; 4014: air blowing port;
402: dust cup; 4021: air intake pipe; 4022: air intake channel; 4023: air intake port; 4024: air outtake port;
422: second cyclone; 4221: air guiding pipe; 4222: air guiding inlet; 4223: air guiding outlet;
4224: air inducing notch; 4225: opening; 4226: connecting wall; 4227: extending part;
423: air inducing channel; 424: partition plate; 425: guiding channel;
403: electric motor; 4031: motor chamber; 4032: air outlet;
404: switching mechanism; 4041: push plate; 4042: communicating opening;
4043: closing plate; 4044: positioning post; 4045: resetting member; 4046: push button;
405: ash pouring plate; 4051: pivoting rod;
406: press button; 407: snap; 408: elastic element;
200: floor brush; 201: floor brush inlet; 202: floor brush opening; 203: floor brush outlet;
204: baffle; 205: bristle.

DETAILED DESCRIPTION

Reference will be made in detail to embodiments of the present disclosure. The same or similar elements and the elements having same or similar functions are denoted by like reference numerals throughout the descriptions. The embodiments described herein with reference to drawings are explanatory, illustrative, and used to generally understand the present disclosure. The embodiments shall not be construed to limit the present disclosure.

In the specification, unless specified or limited otherwise, relative terms such as "central", "length", "width", "thickness", "front", "rear", "right", "left", "lower", "upper", "horizontal", "vertical", "up", "top", "bottom", "inner", "outer", "axial", "radial", "circumferential" as well as derivative thereof (e.g., "horizontally", "downwardly", "upwardly", etc.) should be construed to refer to the orientation as then described or as shown in the drawings under discussion. These relative terms are for convenience of description and do not require that the present disclosure be constructed or operated in a particular orientation. In addition, terms such as "first" and "second" are used herein for purposes of description and are not intended to indicate or imply relative importance or significance. Thus, features limited by "first" and "second" are intended to indicate or imply including one or more than one these features. In the description of the present disclosure, "a plurality of" relates to two or more than two.

In the description of the present disclosure, unless specified or limited otherwise, it should be noted that, terms "mounted," "connected" and "coupled" may be understood broadly, such as permanent connection or detachable connection, electronic connection or mechanical connection, direct connection or indirect connection via intermediary, inner communication or interreaction between two elements. These having ordinary skills in the art should understand the specific meanings in the present disclosure according to specific situations.

In the description of the present disclosure, a structure in which a first feature is "on" a second feature may include an embodiment in which the first feature directly contacts the second feature, and may also include an embodiment in which an additional feature is formed between the first feature and the second feature so that the first feature does not directly contact the second feature, unless otherwise specified. Furthermore, a first feature "on," "above," or "on top of" a second feature may include an embodiment in which the first feature is right "on," "above," or "on top of" the second feature, and may also include an embodiment in which the first feature is not right "on," "above," or "on top of" the second feature, or just means that the first feature has a sea level elevation larger than the sea level elevation of the second feature. While first feature "beneath," "below," or "on bottom of" a second feature may include an embodiment in which the first feature is right "beneath," "below," or "on bottom of" the second feature, and may also include an embodiment in which the first feature is not right "beneath," "below," or "on bottom of" the second feature, or just means that the first feature has a sea level elevation smaller than the sea level elevation of the second feature.

A vacuum cleaner 100 according to embodiments of the present disclosure will be described in the following with reference to FIGS. 1-37. The vacuum cleaner 100 may be a chargeable push-rod vacuum cleaner. In the following descriptions of the present disclosure, the chargeable push-rod vacuum cleaner is taken as an example to illustrate the vacuum cleaner 100. Certainly, those skilled in the related art may understand that the vacuum cleaner 100 may also be another type of vacuum cleaner, but not limited to be the chargeable push-rod vacuum cleaner.

As shown in FIGS. 1-37, the vacuum cleaner 100 according to embodiments of the present disclosure, such as the chargeable push-rod vacuum cleaner, includes a machine body and a handle 1.

The handle 1 is disposed at the machine body and pivotable between a first position and a second position. When the handle 1 is in the first position, the handle 1 is at a front side of the machine body, and when the handle 1 is in the second position, the handle 1 is at a rear side of the machine body. When the handle 1 is at the front side of the machine body, it is convenient for use under a table or bed or similar places; when the handle 1 is at the rear side of the machine body, a volume of the vacuum cleaner 100 can be reduced, thus facilitating packaging thereof.

Figure 2:
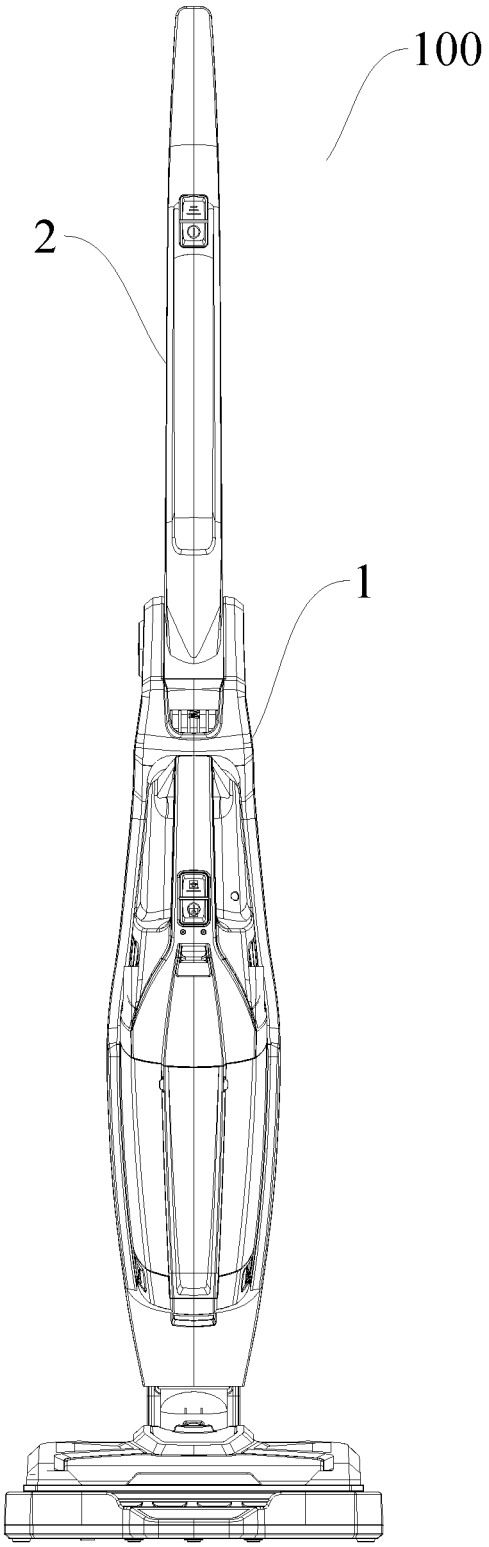
FIG. 2 is a front view of a vacuum cleaner shown in FIG. 1.
Figure 3:
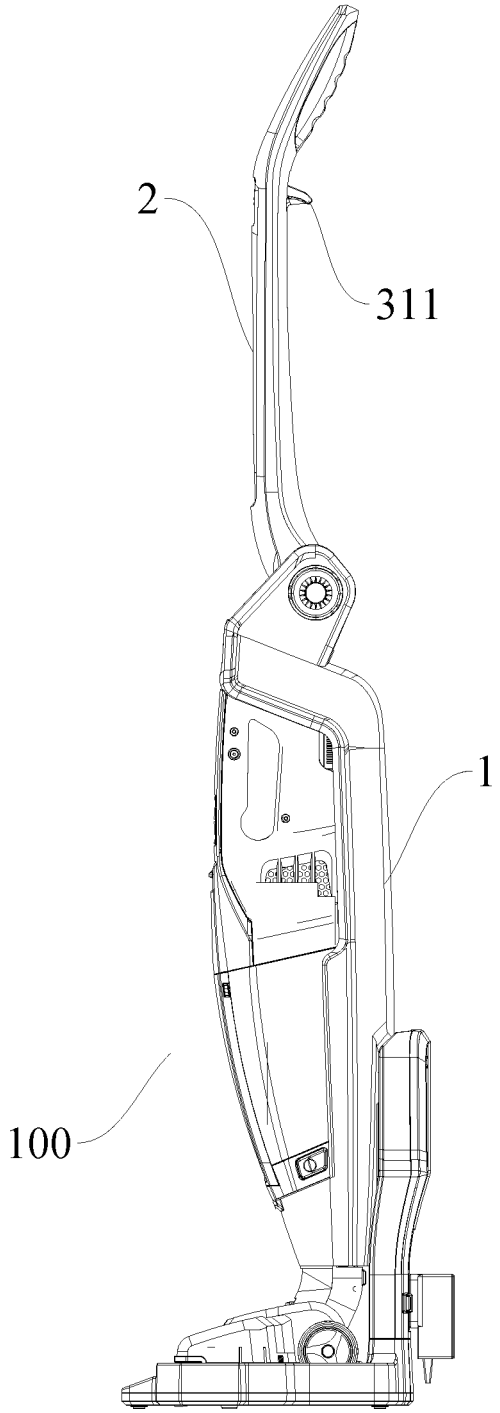
FIG. 3 is a side view of a vacuum cleaner shown in FIG. 1.
Figure 4:
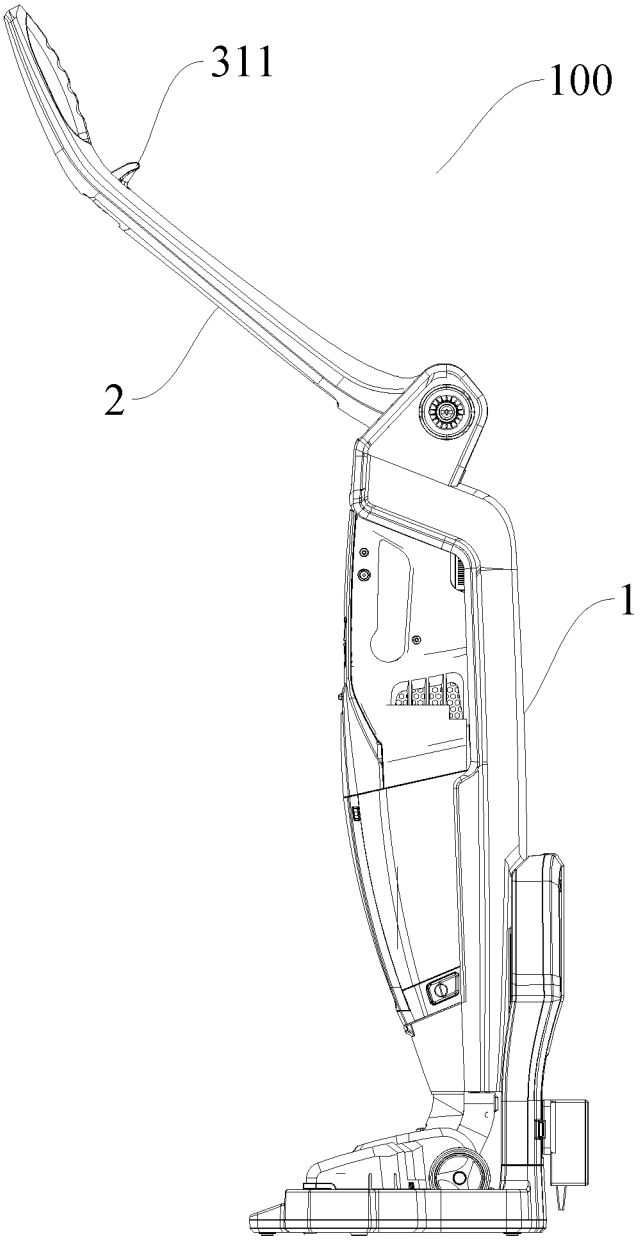
FIG. 4 is a schematic view of a vacuum cleaner shown in FIG. 1, in which a handle is pivoted forwards.
Figure 5:
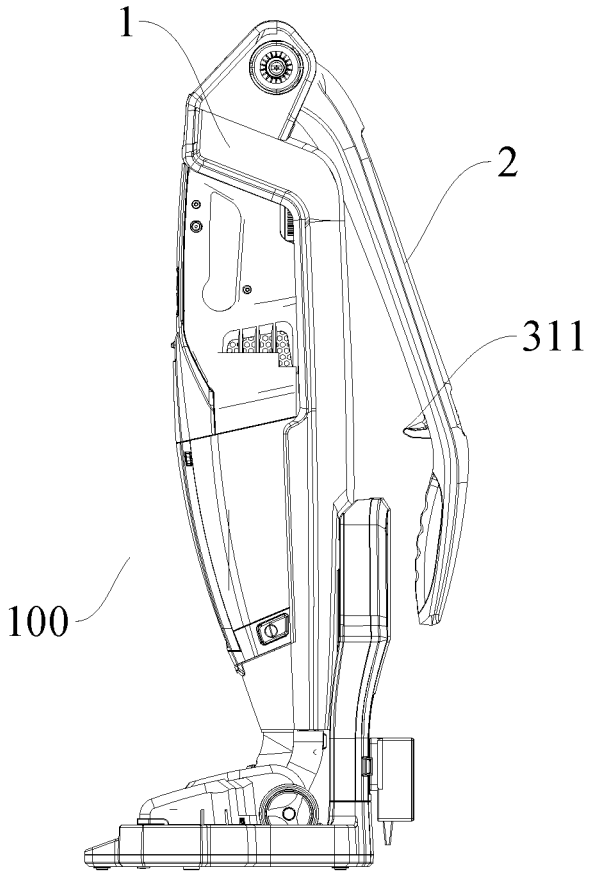
FIG. 5 is a schematic view of a vacuum cleaner shown in FIG. 1, in which a handle is pivoted backwards.

For example, with reference to FIGS. 1-24, the handle 2 is connected to an upper portion of the machine body 1 and is pivotable with respect to the machine body 1. When normally used or in a general storage state, the handle 2 is in a substantially upright state with respect to the machine body 1 (as shown in FIGS. 1-3), i.e., the handle 2 substantially extends upwards vertically from a top of the machine body 1, and a central axis of the handle 2 generally coincides with a central axis of the machine body 1 at this time. When it is needed to clean a place under the table or bed or similar places, the handle 2 may be pivoted forwards so that the entire handle 2 can be in the front side of the machine body 1 (as shown in FIG. 4), and thus it is convenient to clean the place under the table or bed or similar places; when a certain storage requirement needed to be satisfied, the handle 2 may be pivoted backwards so that the handle 2 can be in the rear side of the machine body 1 (as shown in FIG. 5), and thus a space occupied by the entire vacuum cleaner 100 can be reduced, thereby greatly satisfying the requirements of packaging and storage. Herein, it should be noted that direction "front" may be construed as a side of the vacuum cleaner 100 away from a user when the vacuum cleaner 100 is in an actual use, and an opposite direction of direction "front" is defined as direction "rear", i.e., a side of the vacuum cleaner 100 facing the user.

In above descriptions, the handle 2 is pivoted forwards by an angle of $\alpha$ with respect to the machine body 1 from the upright state, and the handle 2 is pivoted backwards by an angle of $\beta$ with respect to the machine body 1 from the upright state, in which $\alpha$, $\beta$ may satisfy following formula respectively: $0°<\alpha\leq 90°$, $0°<\beta\leq 180°$. For example, $\alpha=60°$ or $70°$, $\beta=160°$ or $170°$. It may be understood that specific values of $\alpha$, $\beta$ may be set according to actual requirements so as to satisfy the actual requirements greatly.

When the vacuum cleaner 100 is normally used, the central axis of the handle 1 coincides with the central axis of the machine body, and the vacuum cleaner 100 is in the upright state at this time. when it is needed to clean the place under the table or bed or places inconvenient to clean, the handle 1 may be pivoted forwards by a certain angle of $\alpha$ with respect to the machine body from the above upright state, so that the user can easily hold the handle 1 to clean the place under the table or bed or places inconvenient to clean without the user bending down, when a roll brush of the vacuum cleaner 100 extends to the place under the table or bed or places inconvenient to clean. After cleaning is finished, the handle 1 may be pivoted backwards by a certain angle of $\beta$ with respect to the machine body from the above upright state, so as to reduce the space occupied by the vacuum cleaner 100, thus facilitating storage.

With the vacuum cleaner 100 (such as the chargeable push-rod vacuum cleaner) according to embodiments of the present disclosure, by providing the handle 1 pivotable between the first position and the second position, it is convenient for the vacuum cleaner 100 to be used in the place under the table or bed or similar places, and the vacuum cleaner 100 also satisfies requirements of folding and packaging, has a simple structure and is easy to realize.

According to some embodiments of the present disclosure, at least one lock catch assembly 2 is provided between the machine body and the handle 1. The lock catch assembly 2 is configured to be movable between a locking position for locking the handle 1 and a pivoting position for making the handle 1 pivotable between the first position and the second position. The locking position may be a position in which the handle 1 is in the upright state, and the handle 1 cannot be rotated at this time. Optionally, one or more than one lock catch assembly 2 may be provided.

A vacuum cleaner 100 (such as the chargeable push-rod vacuum cleaner) according to an embodiment of the present disclosure will be described with reference to FIGS. 1-17.

Figure 6:
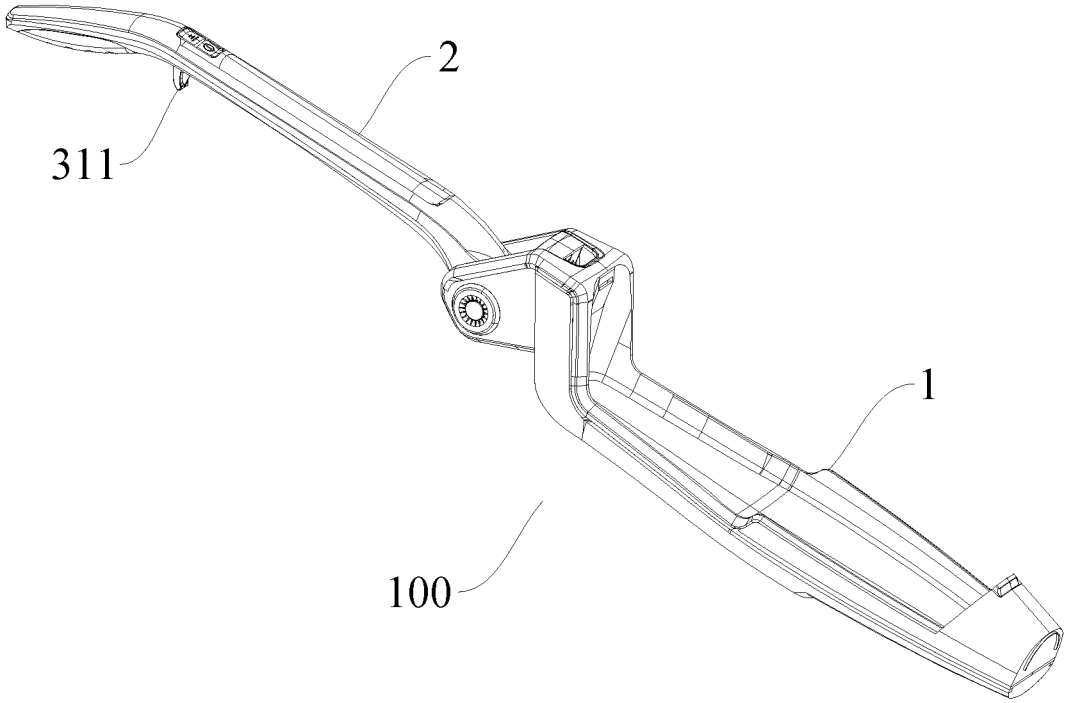
FIG. 6 is a partially schematic view of a handle and a machine body shown in FIG. 1.

With reference to FIG. 6, in combination with FIGS. 7-15, the lock catch assembly is disposed between the machine body 1 and the handle 2, and the handle 2 is movable with respect to the machine body 1 or not by the lock catch assembly. Specifically, the lock catch assembly includes a pull rod 31 and a pull block 32, the pull rod 31 is disposed in the handle 2 and movable between a fixing position and a releasing position, the pull rod 31 is preferably coaxial with handle 2, and the pull block 32 is connected to an end of the pull rod 31 adjacent to a center of the machine body 1 (for example, a lower end in FIG. 7). One of the pull block 32 and the machine body 1 is provided with a fixing protrusion 321, and the other one of the pull block 32 and the machine body 1 is provided with a fixing groove 11, i.e., when the fixing protrusion 321 is provided on the pull block 32, the fixing groove 11 is provided in the machine body 1 (as shown in FIGS. 12-15), and when the fixing protrusion 321 is provided on the machine body 1, the fixing groove 11 is provided in the pull block 32 (not shown in figures). The fixing groove 11 preferably has a shape matched with a shape of the fixing protrusion 321. It may be understood that, specific shapes and configurations of the fixing protrusion 321 and the fixing groove 11 may be set according to actual requirements, which is not limited by the present disclosure.

Figure 7:
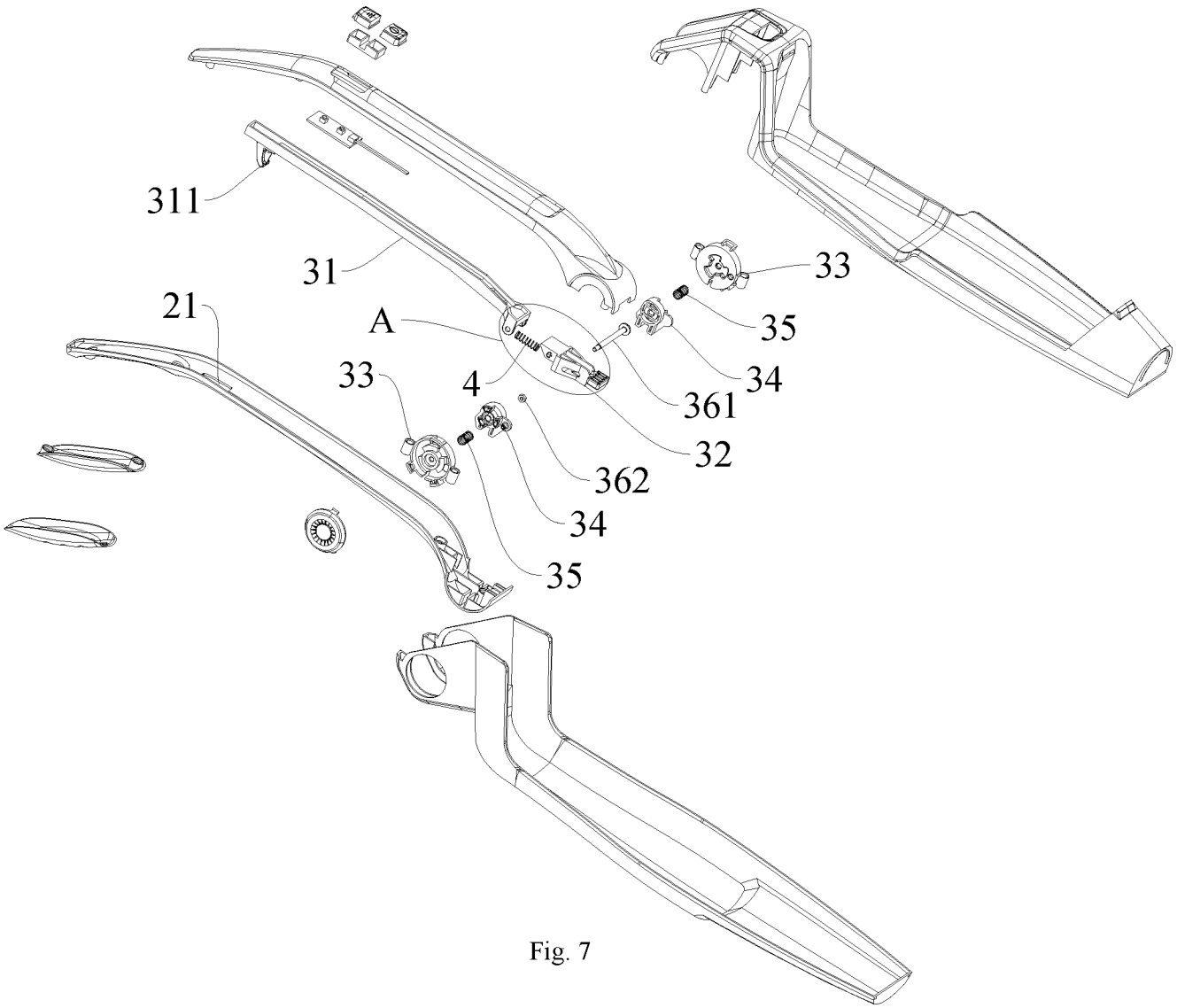
FIG. 7 is an exploded view of a handle and a machine body shown in FIG. 6.

Optionally, the pull rod 31 and the pull block 32 may be two independent parts respectively. With reference to FIG. 7, in combination with FIG. 8, the pull rod 31 and the pull block 32 are produced independently and respectively, thus reducing manufacturing difficulty and accuracy of the pull rod 31 and saving cost. Specifically, the pull block 32 is connected with the pull rod 31 via a connecting structure. The connecting structure includes two ear plates 312 and two connecting posts 322, the two ear plates 312 are disposed on the pull rod 31 and spaced apart from each other, each ear plate 312 has a connecting hole 3121 therein, and the two connecting posts 322 are disposed on the pull block 32 and spaced apart from each other. The two connecting posts 322 are respectively fitted with the two connecting holes 3121 so as to connect the pull block 32 to the pull rod 31.

Certainly, the pull rod 31 may also be integral with the pull block 32, and the pull rod 31 and the pull block 32 are produced as a whole at this time, thus reducing parts of the vacuum cleaner 100, facilitating assembling and improving assembling efficiency.

When the pull rod 31 is in the fixing position, the fixing protrusion 321 is fitted with the fixing groove 11 so that the handle 2 is fixed with respect to the machine body 1, i.e., the handle 2 cannot be rotated with respect to the machine body 1. Herein, it should be noted that "fixed" may be construed as a meaning that the handle 2 cannot be moved with respect to the machine body 1 at all, or, the handle 2 may be slightly moved with respect to the machine body 1, but the movement thereof is in a very small range. For example, due to limitations of processing and assembling of the fixing protrusion 321 and the fixing groove 11, a gap is formed between the fixing protrusion 321 and the fixing groove 11, so that the handle 2 can still move with respect to the machine body 1 to a certain extent, when the fixing protrusion 321 is fitted with the fixing groove 11. When the pull rod 31 is in the releasing position, the fixing protrusion 321 is separated from the fixing groove 11 so that the handle 2 can be rotated forwards and backwards with respect to the machine body 1, in which whether the handle 2 is rotated forwards or backwards is dependent on user's actual requirements.

With the vacuum cleaner 100 according to embodiments of the present disclosure, by providing the lock catch assembly, the handle 2 can be rotated forwards so that it is convenient for the vacuum cleaner to be used in the place under the table or bed, and the handle 2 can also be rotated backwards so as to satisfy the requirements of folding and packaging, moreover, the handle 2 is fixed with respect to the machine body 1 when the pull rod 31 is in the fixing position, thus ensuring user's normal use.

According to an embodiment of the present disclosure, with reference to FIG. 7, in combination with FIGS. **9*a*-10*b*, the lock catch assembly further includes: a retainer 33 and a lock catch 34. The retainer 33 is disposed on the machine body 1. For example, the retainer 33 may be fixed on the machine body 1, and the retainer 33 is immovable with respect to the machine body 1 at this time, i.e., the retainer 33 has no movement with respect to the machine body 1. The lock catch 34 is disposed on the handle 2, and the lock catch 34 is located between the retainer 33 and the pull block 32. For example, the lock catch 34 is fixed on the handle 2 and configured to be separably fitted with the retainer 33. When the pull rod 31 is in the fixing position, the lock catch 34 is fitted with retainer 33, thus further ensuring that the handle 2 is immovable with respect to the machine body 1. At this time, the fixing protrusion 321 and the fixing groove 11, as well as the lock catch 34 and the retainer 33 function as a dual protection. When the pull rod 31 is in the releasing position, the lock catch 34 is separated from the retainer 33, so that the handle 2 can be rotated forwards or backwards successfully with respect to the machine body 1**.

Furthermore, one of lock catch 34 and the retainer 33 is provided with a fitting part, the other one of the lock catch 34 and the retainer 33 is provided with a fitting groove, and the fitting part is configured to be separably fitted with the fitting groove. Optionally, the fitting part includes a plurality of fitting teeth 341 arranged in a circumferential direction of the one of the lock catch 34 and the retainer 33 and spaced from one another, the fitting groove includes a plurality of sub fitting grooves 331 arranged in a circumferential direction of the other one of the lock catch 34 and the retainer 33 and spaced from one another, the plurality of fitting teeth 341 is configured to be separably fitted with the plurality of sub fitting grooves 331.

Figure 9A:
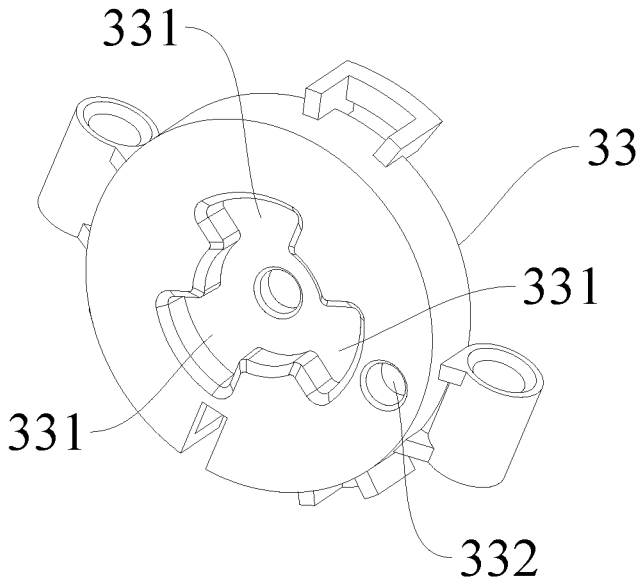
FIG. 9*a* is a schematic view of a retainer shown in FIG. 7.
Figure 10A:
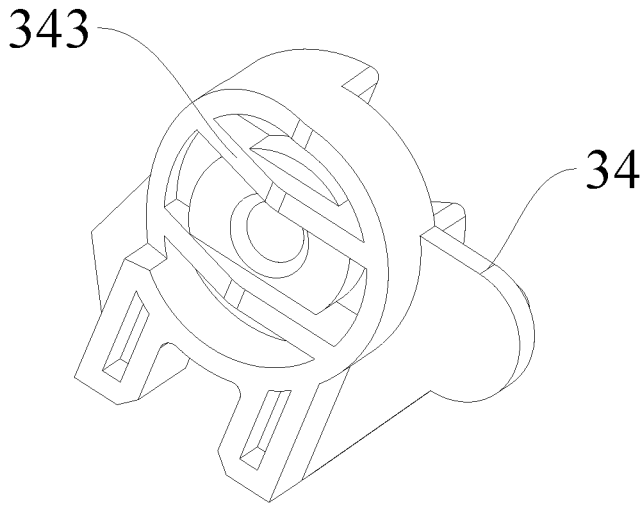
FIG. 10*a* is a schematic view of a lock catch shown in FIG. 7.
Figure 10B:
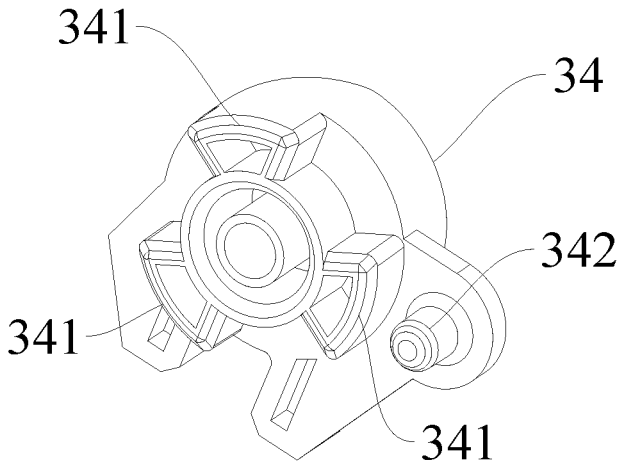
FIG. 10*b* is another schematic view of a lock catch shown in FIG. 7.
Figure 11:
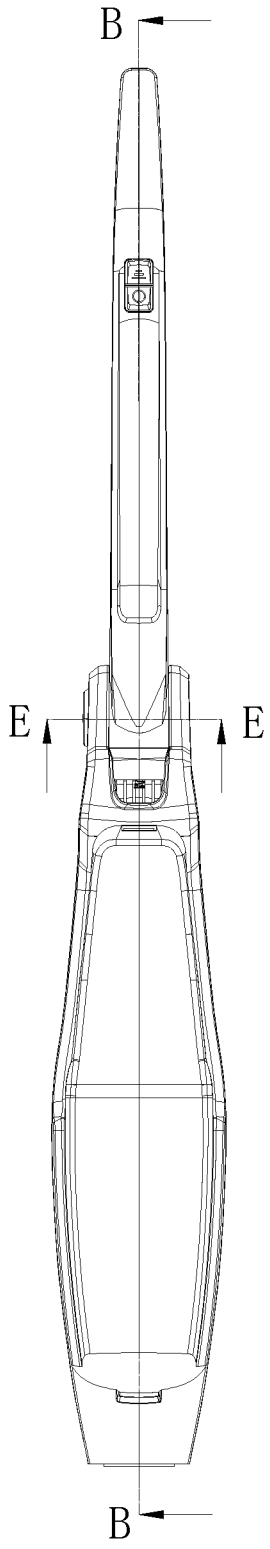
FIG. 11 is a front view of a handle and a machine body shown in FIG. 6.

For example, as shown in FIGS. 9*a* and 10*b*, a round groove is formed in a side surface of the retainer 33 adjacent to the lock catch 34 and recessed in a direction running away from the lock catch 34, three sub fitting grooves 331 are evenly provided in a circumferential direction of the round groove and spaced from one another, and all the three sub fitting grooves 331 communicate with the round groove so as to be easy to produce. Correspondingly, three fitting teeth 341 are provided on a side surface of the lock catch 34 adjacent to the retainer 33, the three fitting teeth 341 are evenly distributed in a circumferential direction of the lock catch 34 and spaced from one another, and the fitting tooth 341 preferably has a shape matched with a shape of the fitting groove. For example, each fitting tooth 341 has a substantial sector shape. When the pull rod 31 is in the fixing position, the tree fitting teeth 341 extends into corresponding fitting grooves respectively. When the pull rod 31 is in the releasing position, the lock catch 34 moves away from the retainer 33 so that all the three fitting teeth 341 are separated from the corresponding fitting grooves. Each fitting tooth 341 may have a hollow configuration so as to save materials and reduce a material cost. It may be understood that, specific shapes of the fitting tooth 341 and the fitting groove may be adjusted adaptably according to actual assembling requirements, which is not limited by the present disclosure.

Optionally, one of a surface of the lock catch 34 and a surface of the retainer 33 opposite to each other is provided with a guiding post 342, the other one of the surface of the lock catch 34 and the surface of the retainer 33 opposite to each other is provided with a guiding hole 332, and the fitting part is fitted with the fitting groove when the guiding post 342 extends into the guiding hole 332. Furthermore, an end surface of a free end of the guiding post 342 may extend beyond a side surface of the fitting part adjacent to the retainer 33.

For example, with respect to FIG. 7, in combination with FIGS. 9*a* and 10*b*, the guiding post 342 is disposed on the surface of the lock catch 34 opposite to the retainer 33 and at an outer side of the fitting part, and the guiding post 342 has a substantial cylinder shape. A free end of the guiding post 342 is configured to have a cross sectional area gradually decreased in a direction running away from another end of the guiding post 342, so as to extend into the guiding hole 332 easily. In a width direction of the lock catch 34, the guiding post 342 has a height preferably larger than a thickness of the fitting part, so that when the pull rod 31 is in the fixing position, the guiding post 342 may first extend into the guiding hole 332 to be fitted with the guiding hole 332. At this time, the retainer 33 and the lock catch 34 can be positioned well, and thus it is convenient for the fitting part to be fitted with the fitting groove quickly and accurately in subsequent procedures. The guiding hole 332 is formed in the surface of the retainer 33 opposite to the lock catch 34 and is opposed to the guiding post 342.

Figure 8:
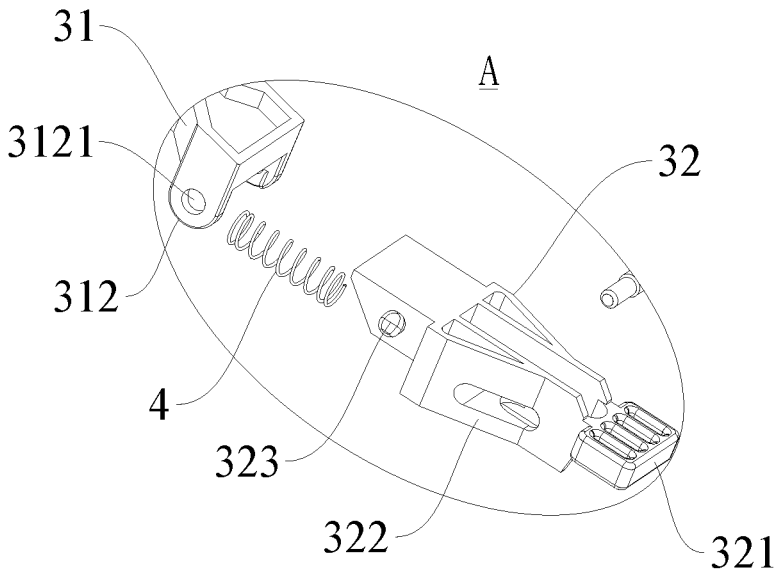
FIG. 8 is an enlarged view of portion A circled in FIG. 7.

As shown in FIGS. 8 and 10*a*, a side surface of the lock catch 34 adjacent to the pull block 32 is provided with a first inclined surface 343, and the first inclined surface 343 is configured to obliquely extend in a direction approaching a central axis of the handle 2 from top to bottom. A side surface of the pull block 32 adjacent to the lock catch 34 is provided with a second inclined surface 322, and the second inclined surface 322 is configured to obliquely extend in a direction running away from the central axis of the handle 2 from bottom to top. When the pull rod 31 is moved to the releasing position from the fixing position, the first inclined surface 343 is fitted with the second inclined surface 322 so that the lock catch 34 moves away from the retainer 33.

Specifically, when the pull rod 31 is moved to the releasing position from the fixing position, for example, the pull rod 31 may drive the pull block 32 to move away from the machine body 1, in the process, since the first inclined surface 343 touches the second inclined surface 322 all the time, the lock catch 34 will move away from the retainer 33, so that the fitting part is separated from the fitting groove, and thus the lock catch 34 is released. In the above process, the fixing protrusion 321 of the pull block 32 also moves away from the fixing groove 11 in the machine body 1 gradually and is finally separated from the fixing groove 11, so that the handle 2 can be rotated forwards or backwards. When the pull rod 31 is moved to the fixing position form the releasing position, for example, the pull rod 31 may drive the pull block 32 to move towards the machine body 1, in this process, since the first inclined surface 343 touches the second inclined surface 322 all the time, the pull block 32 pushes the lock catch 34 to move towards the retainer 33, so that the fitting part is fitted within the fitting groove, and the lock catch 34 is locked by the retainer 33. In the above process, the fixing protrusion 321 of the pull block 32 extends into the fixing groove 11 in the machine body 1 to be fitted within the fixing groove 11, and thus the handle 2 is locked, so that the handle 2 cannot be rotated with respect to the machine body 1.

Furthermore, as shown in FIG. 7, the vacuum cleaner 100 further includes a first resetting member 35, the first resetting member 35 is disposed between the retainer 33 and the lock catch 34, and the first resetting member 35 is configured to constantly push the lock catch 34 in a direction running away from a center of the retainer 33. Optionally, the first resetting member 35 is configured as a spring, but not limited to this. Thus, by providing the first resetting member 35, when the pull rod 31 is moved from the fixing position to the releasing position, the first resetting member 35 (such as the spring) may push the lock catch 34 to move away from the retainer 33 by using its own elasticity function.

Preferably, as shown in FIG. 7, two retainers 33 and two lock catches 34 are provided, the two retainers 33 are bilaterally symmetrical with respect to a center of the pull block 32, and the two lock catches 34 are also bilaterally symmetrical with respect to the center of the pull block 32. Thus, the motion stability can be ensured effectively.

The handle 2 is pivotably connected with the machine body 1 via a pivoting shaft, and the pivoting shaft penetrates through the lock catch assembly. Specifically, for example, the pivoting shaft may include a threaded fastener and at least one nut 362, and the nut 362 is connected to a free end of the threaded fastener. Herein, it should be noted that, when the threaded fastener is a bolt 361, the free end is an end of the bolt 361 away from a head of the bolt 361; when the threaded fastener is a stud, each end of the stud is the free end, and at this time, two nuts 362 are provided and respectively connected to two ends of the stud by threaded connection.

As shown in FIG. 7, two lock catches 34, two retainers 33 and two first resetting members 35 are provided. During assembling, the retainer 33, the first resetting member 35 (such as the spring), the lock catch 34, the pull block 32, the lock catch 34, the first resetting member 35 (such as the spring) and the retainer 33 are sleeved onto the bolt 361 in turn from right to left via the free end of the bolt 361, and finally the nut 362 is fastened to the free end of the bolt 361, so that the respective parts fitted over the bolt 361 are prevented from falling off from the free end of the bolt 361.

Figure 16:
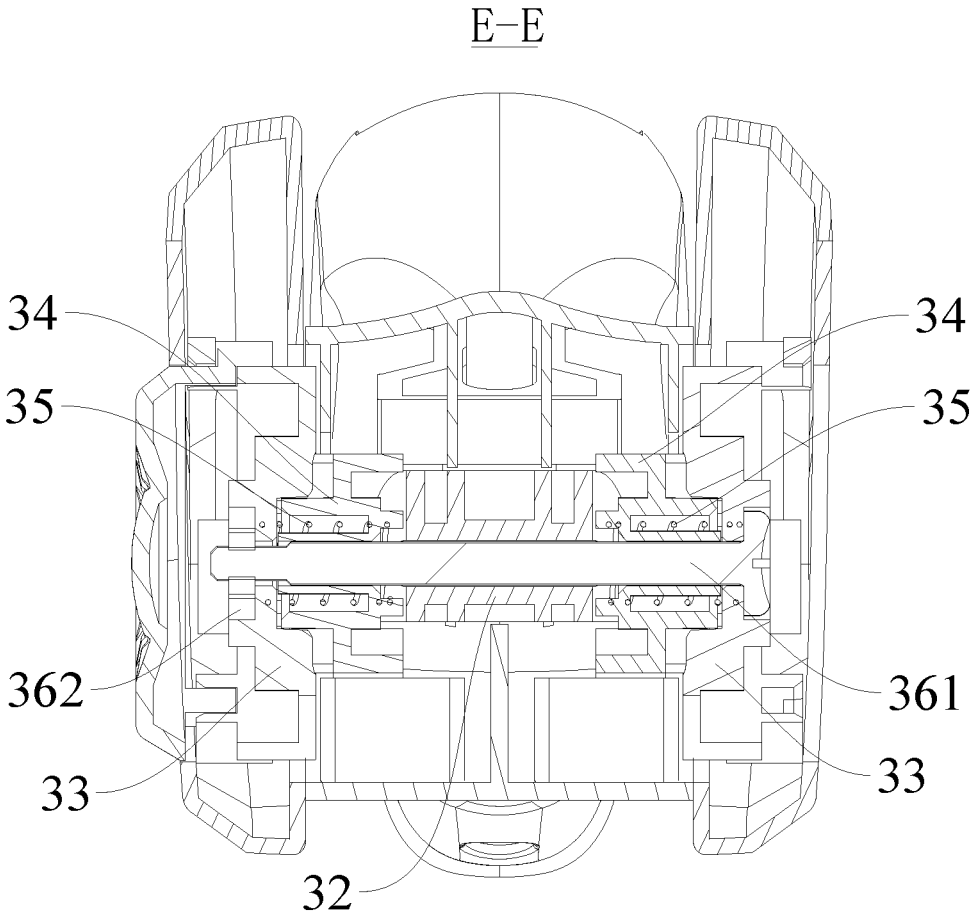
FIG. 16 is a sectional view along line E-E in FIG. 11.

With reference to FIG. 7, in combination with FIG. 16, when the pull rod 31 is moved from the fixing position to the releasing position, the pull rod 31 is moved in a direction running away from the center of the machine body 1 (for example, in an upper direction in FIG. 7) and in a length direction of the handle 2. Certainly, the pull rod 31 may be moved leftwards or rightwards (not shown in figures).

Figure 17:
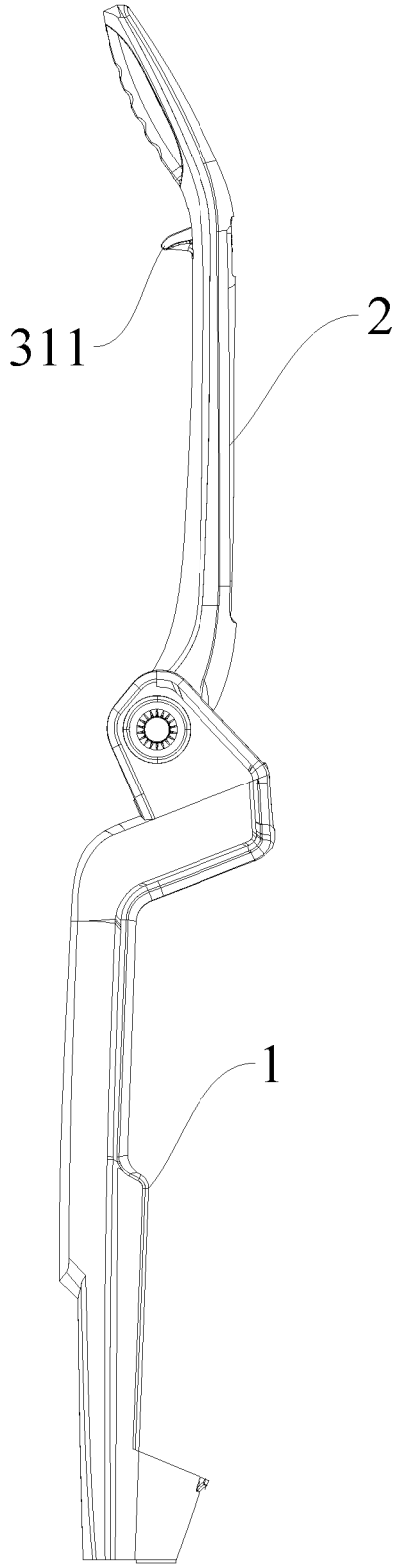
FIG. 17 is a side view of a handle and a machine body shown in FIG. 11.

When the pull rod 31 is in the fixing position, the handle 2 is in the substantially upright state (such as a state in FIG. 3) with respect to the machine body 1, so that it is convenient for the user to perform a normal cleaning (such as a floor cleaning) or a normal storage (for example, the vacuum cleaner 100 is placed in a corner of a room when not used). Herein, it should be noted that, "the handle 2 is in the substantially upright state with respect to the machine body 1" may be construed as a meaning that a central axis of the handle 2 totally coincides with the central axis of the machine body 1, or, as shown in FIGS. 3 and 17, due to specific configurations of the handle 2 and the machine body 1, the central axis of the handle 2 may be slightly offset with respect to the central axis of the machine body 1, and the offset is in a relatively small range, so that the user may hold a view that the handle 2 is coaxial with the machine body 1 when the user sees the vacuum cleaner 100.

Figure 12:
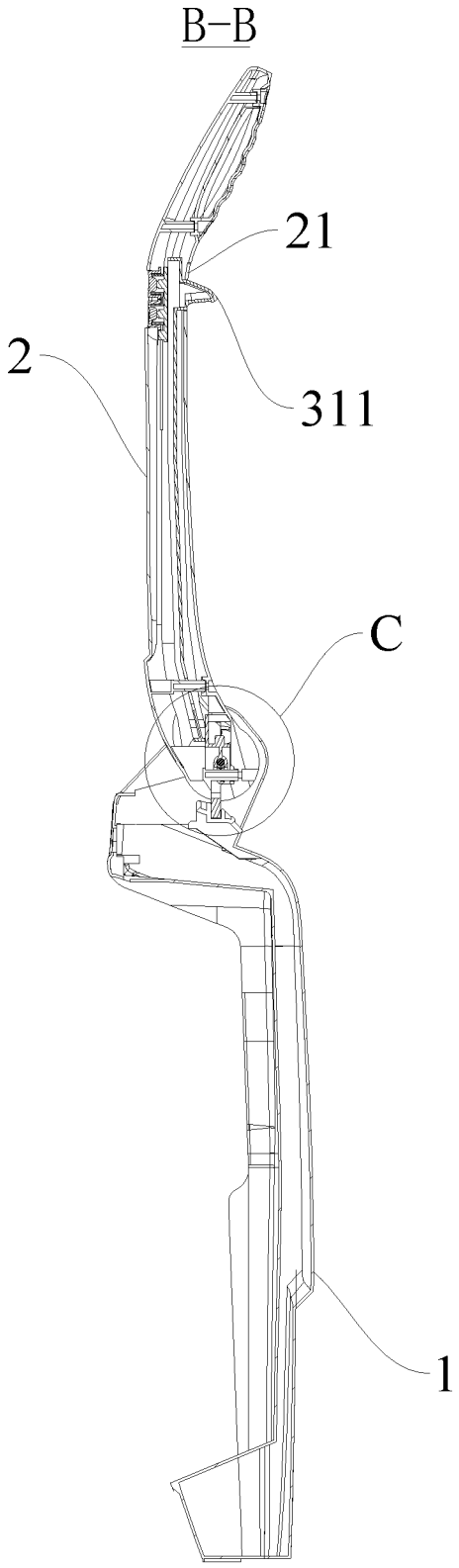
FIG. 12 is a sectional view along line B-B in FIG. 11, in which a fixing protrusion is fitted with a fixing groove.
Figure 14:
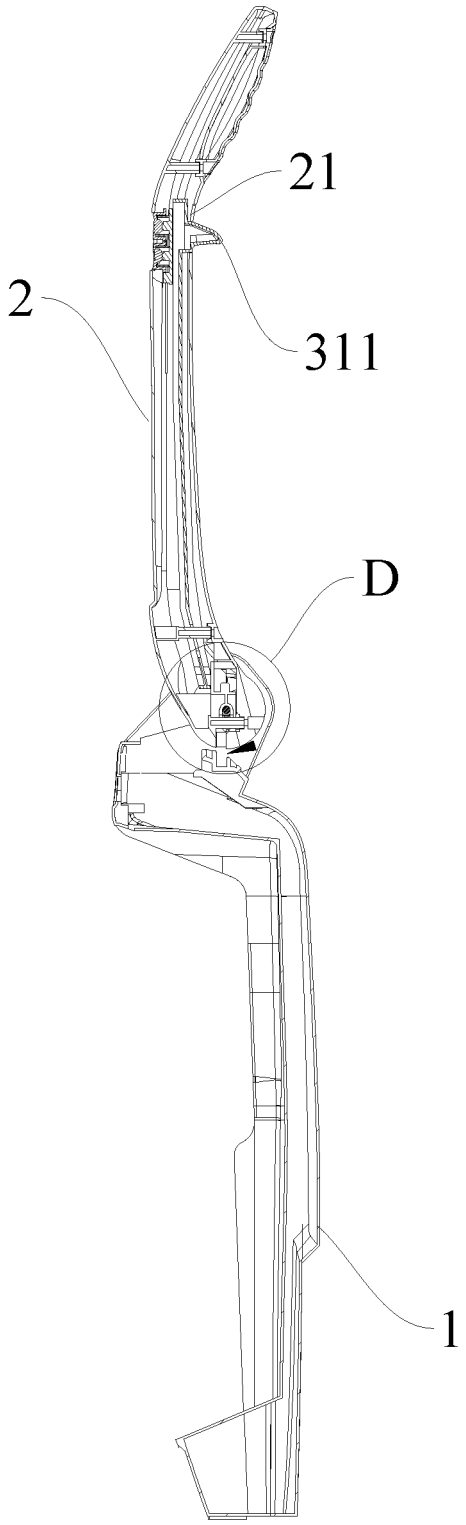
FIG. 14 is a sectional view of a handle and a machine body according to an embodiment of the present disclosure, in which a fixing protrusion is separated from a fixing groove.
Figure 15:
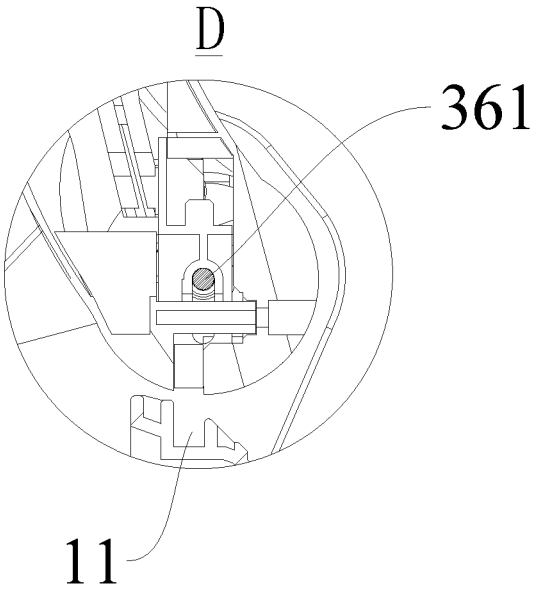
FIG. 15 is an enlarged view of portion D circled in FIG. 14.

With reference to FIGS. 3-7, in combination with FIGS. 12 and 14, the pull rod 31 is provided with a pull rod button 311, the pull rod button 311 may be in an upper portion of the handle 2, the handle 2 may be provided with an opening 21, and the pull rod button 311 extends out of the handle 2 through the opening 21. Thus, by providing the pull rod button 311, it is convenient for the user to pull the pull rod button 311 with a finger, and thus the pull rod 31 can be moved between the fixing position and the releasing position.

As shown in FIG. 8, the vacuum cleaner 100 further includes a second resetting member 4, and the second resetting member 4 is disposed in the handle 2. For example, the second resetting member 4 is compressed between the handle 2 and the pull block 32 and configured to constantly push the pull block 32 towards the fixing position. Optionally, the second resetting member 4 may be configured as a spring, but not limited to this. Thus, by providing the second resetting member 4, when the pull rod 31 is in the releasing position and in the upright state, the pull block 32 may be moved to the fixing position under a function of the second resetting member 4 (such as the spring), so that the fixing protrusion 321 is fitted in fixing groove 11 without user's operations.

With the vacuum cleaner 100 (such as the chargeable push-rod vacuum cleaner) according to embodiments of the present disclosure, when the vacuum cleaner 100 is packaged, the handle 2 may be pivoted backwards, and the volume of the vacuum cleaner 100 is very small at this time, which saves the packaging space and the packaging cost; when the vacuum cleaner 100 is used, the handle 2 may be pivoted forwards, so that the user can clean low places such as the place under the table or bed without the user bending down; after the vacuum cleaner 100 is used, the handle 2 may be pivoted backwards, the volume of the vacuum cleaner 100 is very small at this time, and thus it is convenient for the vacuum cleaner 100 to be received in a cabinet and a small space is occupied.

A vacuum cleaner 100 (such as a changeable push-rod vacuum cleaner) according to another embodiment of the present disclosure will be described in the following with reference to FIGS. 18-24.

Figure 21:
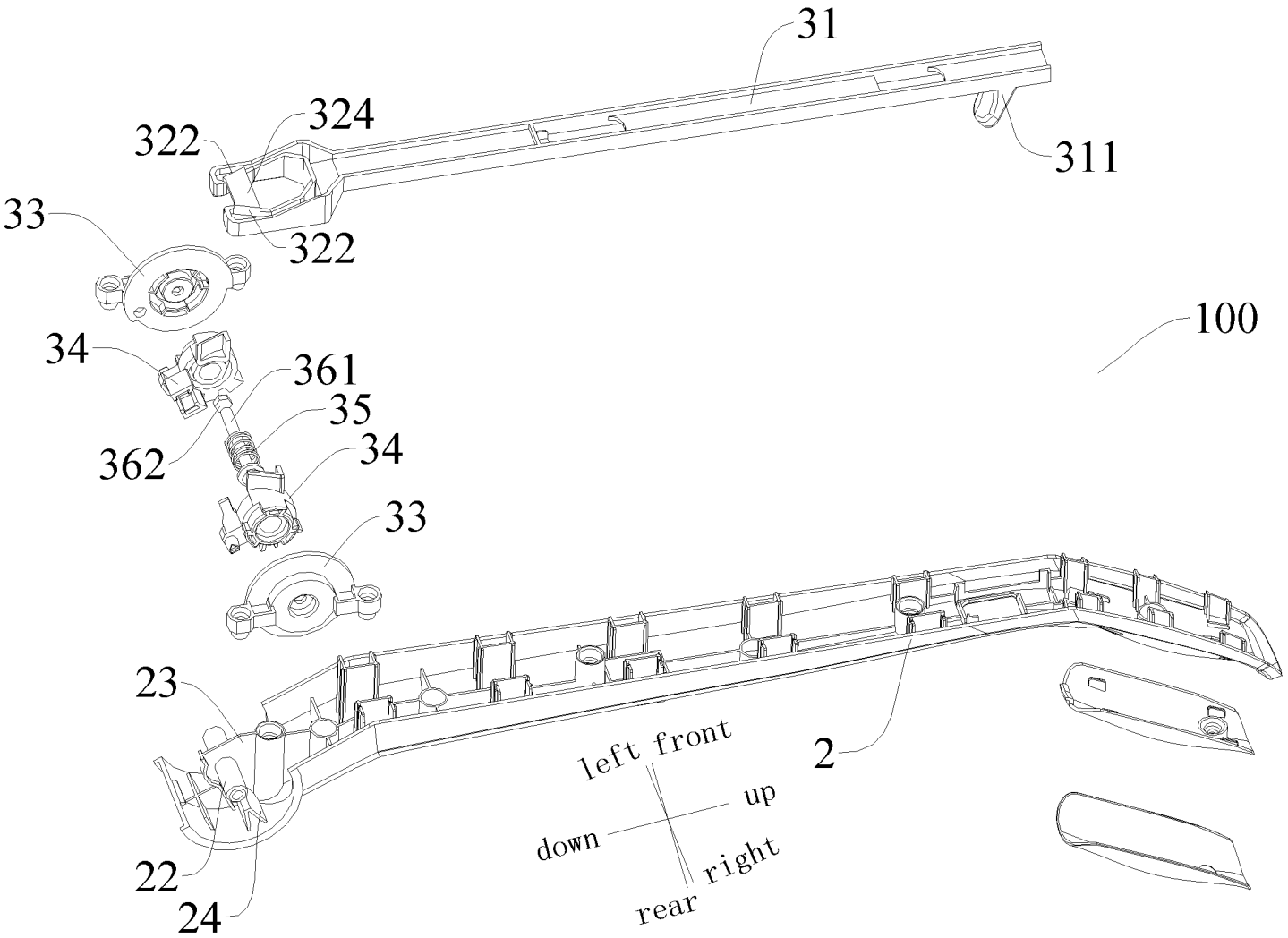
FIG. 21 is an exploded view of a handle shown in FIG. 1.

Specifically, as shown in FIGS. 18-24, a handle 1 is pivotably connected to a machine body 1 via a pivoting shaft 22. With reference to FIGS. 7 and 21, the pivoting shaft 22 is located at an end of the handle 1 adjacent to the machine body 1 (for example, a lower end in FIG. 21), a separating plate 23 is provided at the above end of the handle 1, and the pivoting shaft 22 penetrates through the separating plate 23.

Each lock catch assembly 2 includes a retainer 33 and a lock catch 34. The retainer 33 is disposed to the machine body 1, the lock catch 34 is fitted over the pivoting shaft 22, and the lock catch 34 is configured to be separably fitted with the retainer 33. When the lock catch assembly 2 is in a locking position, the lock catch 34 is fitted with the retainer 33, and the handle 1 cannot be rotated forwards or backwards with respect to the machine body 1 at this time. When the lock catch assembly 2 is in a pivoting position, the lock catch 34 is separated from the retainer 33, and the handle 1 can be rotated between a first position and a second position with respect to the machine body 1.

Specifically, the lock catch 34 is provided with a plurality of fitting teeth 221 arranged in a circumferential direction of the lock catch 34 and spaced from one another, the retainer 33 is provided with a plurality of sub fitting grooves 331 arranged in a circumferential direction of the retainer 33 and spaced from one another, the plurality of fitting teeth 221 are configured to be separably fitted with the plurality of sub fitting grooves 331. When the fitting tooth 221 is fitted with the sub fitting groove 331, the handle 1 may be fixed in the locking position; when the fitting tooth 221 is separated from the sub fitting groove 331, the handle 1 may be pivoted forwards or backwards, so that the handle 1 is pivotable between the first position and the second position.

Figure 23:
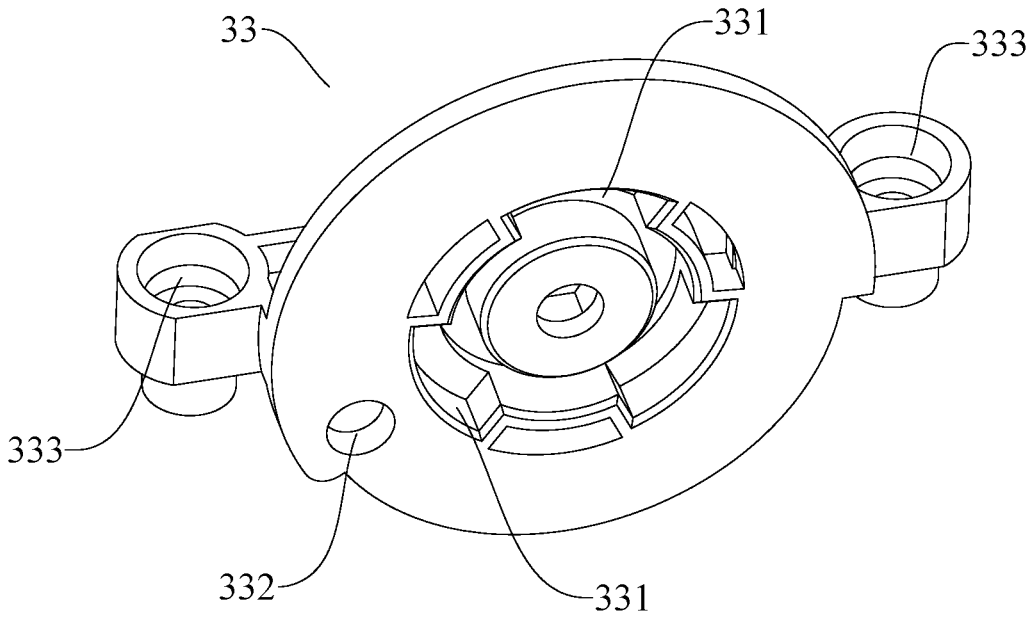
FIG. 23 is a schematic view of a retainer shown in FIG. 22.
Figure 24:
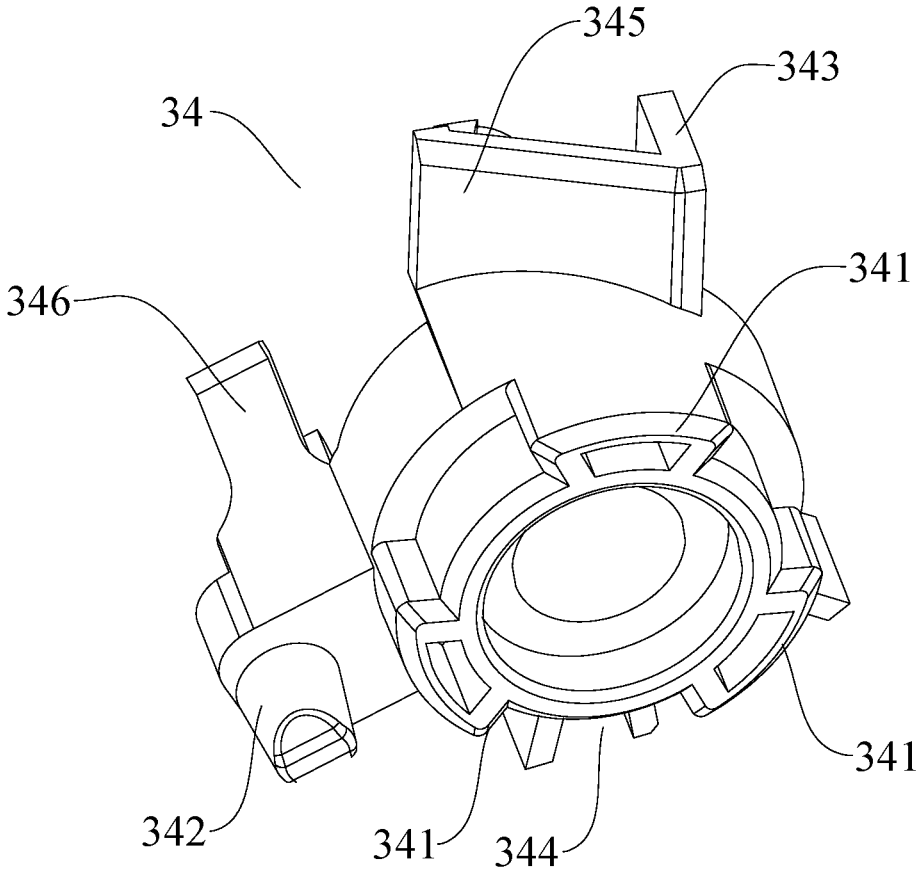
FIG. 24 is a schematic view of a lock catch shown in FIG. 22.
Figure 25:
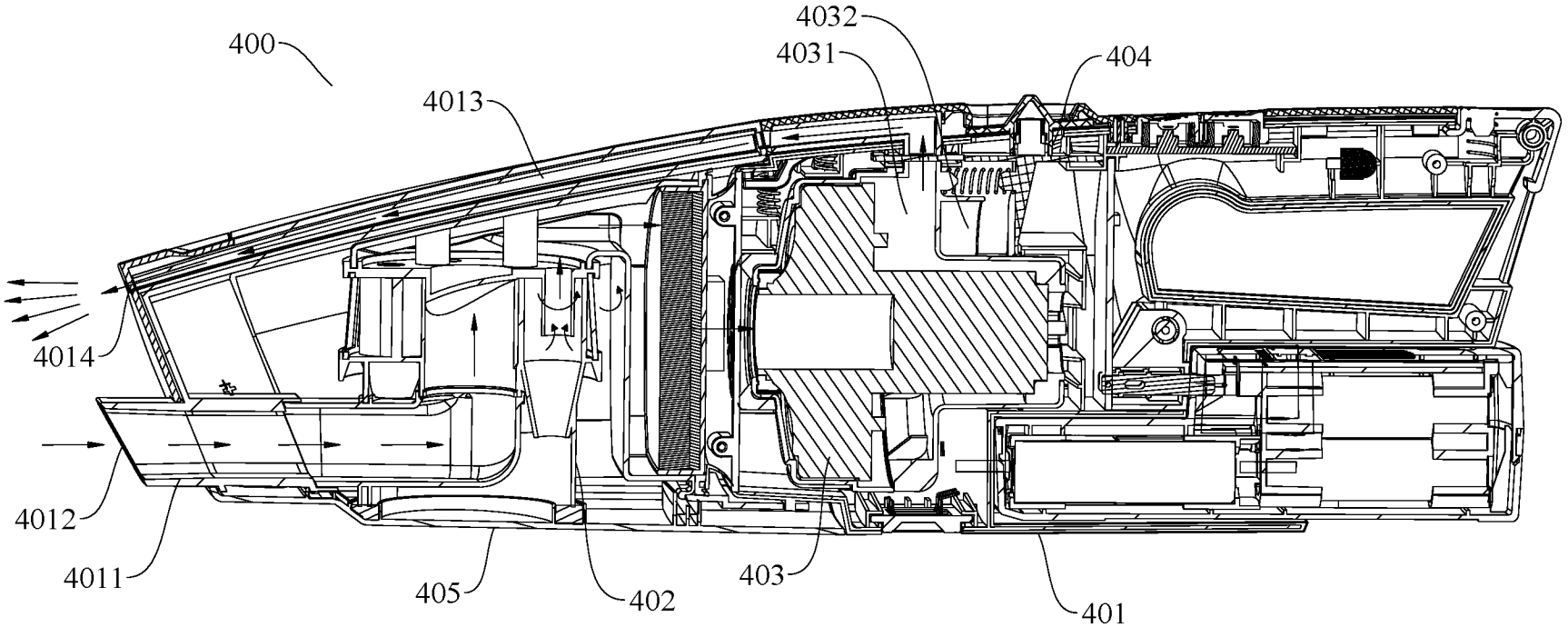
FIG. 25 is a schematic view of a hand-held device of a vacuum cleaner according to an embodiment of the present disclosure.
Figure 26:
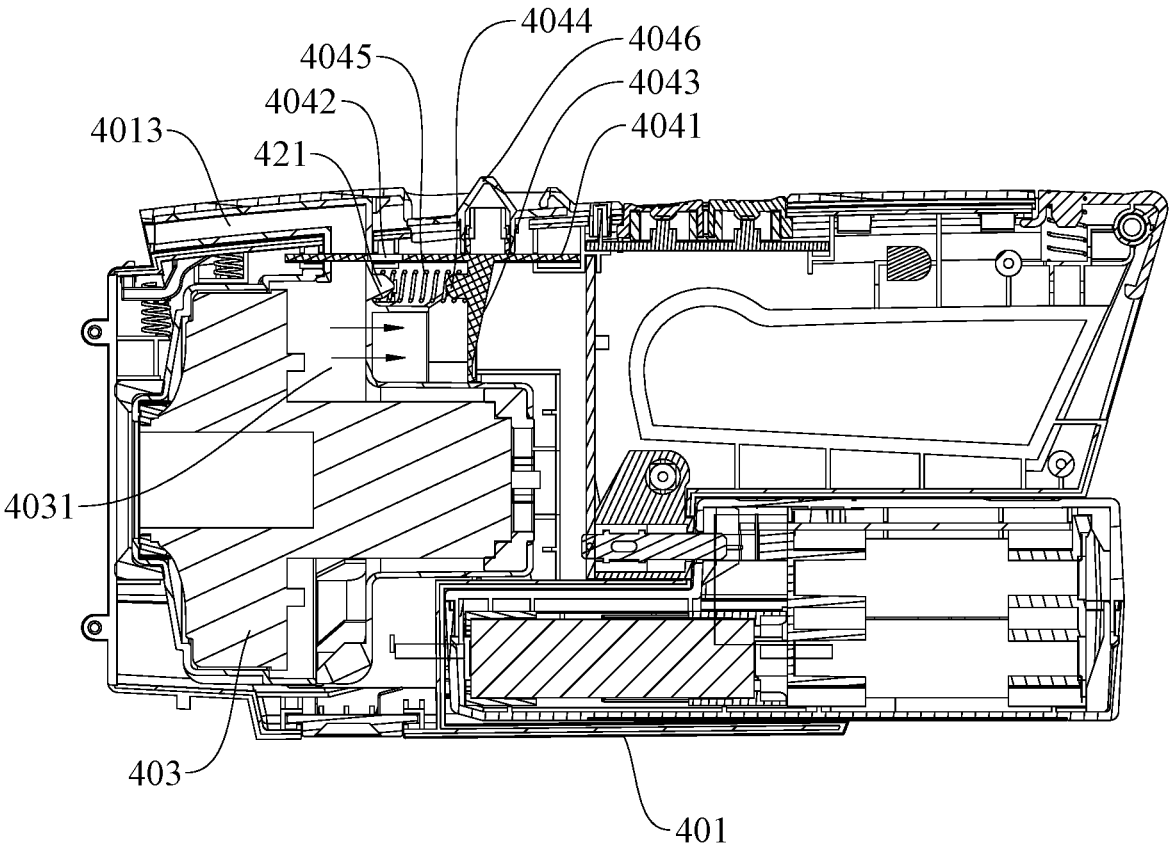
FIG. 26 is a partially schematic view of a hand-held device shown in FIG. 25, in which a switching mechanism is in a partitioning position.
Figure 27:
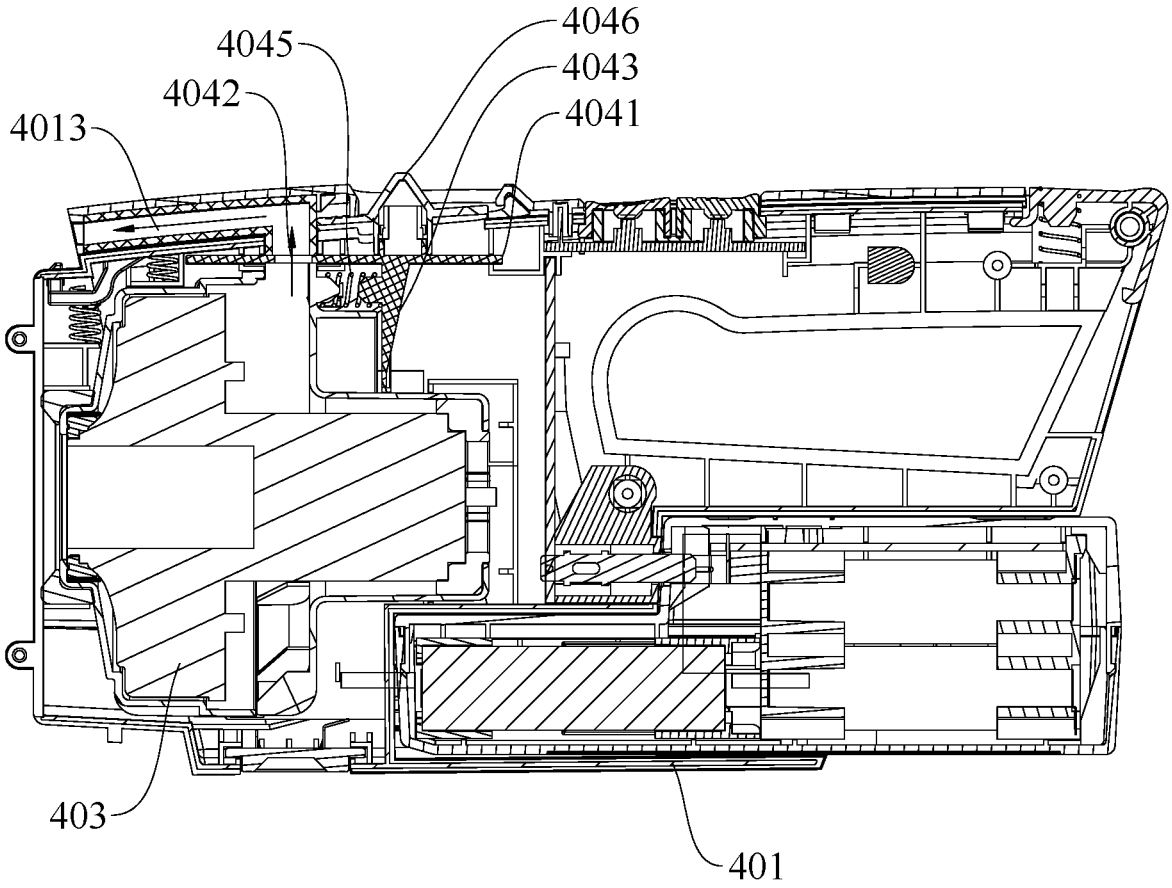
FIG. 27 is another partially schematic view of a hand-held device shown in FIG. 25, in which a switching mechanism is in a communicating position.
Figure 28:
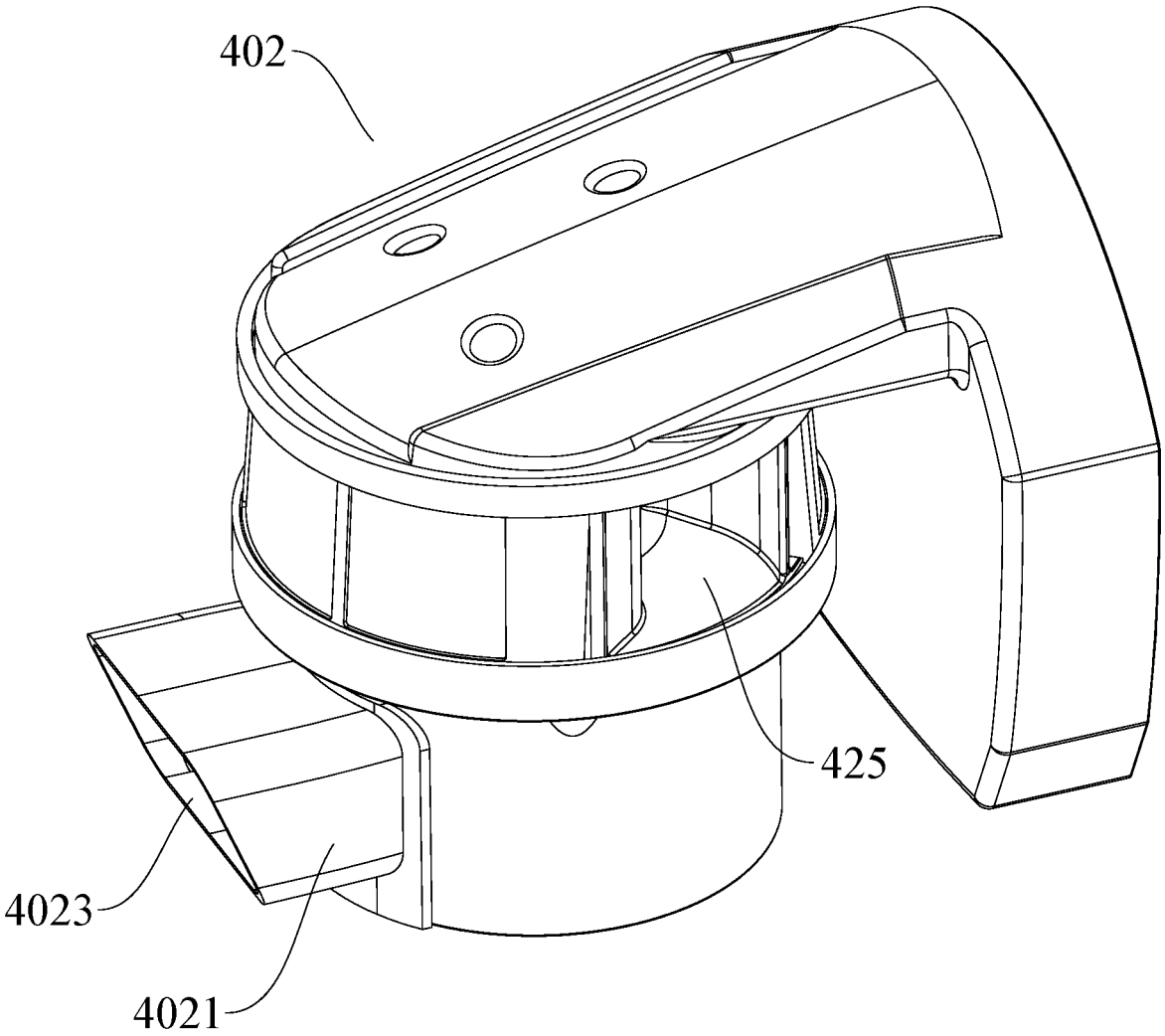
FIG. 28 is a perspective view of a dust cup shown in FIG. 25.
Figure 29:
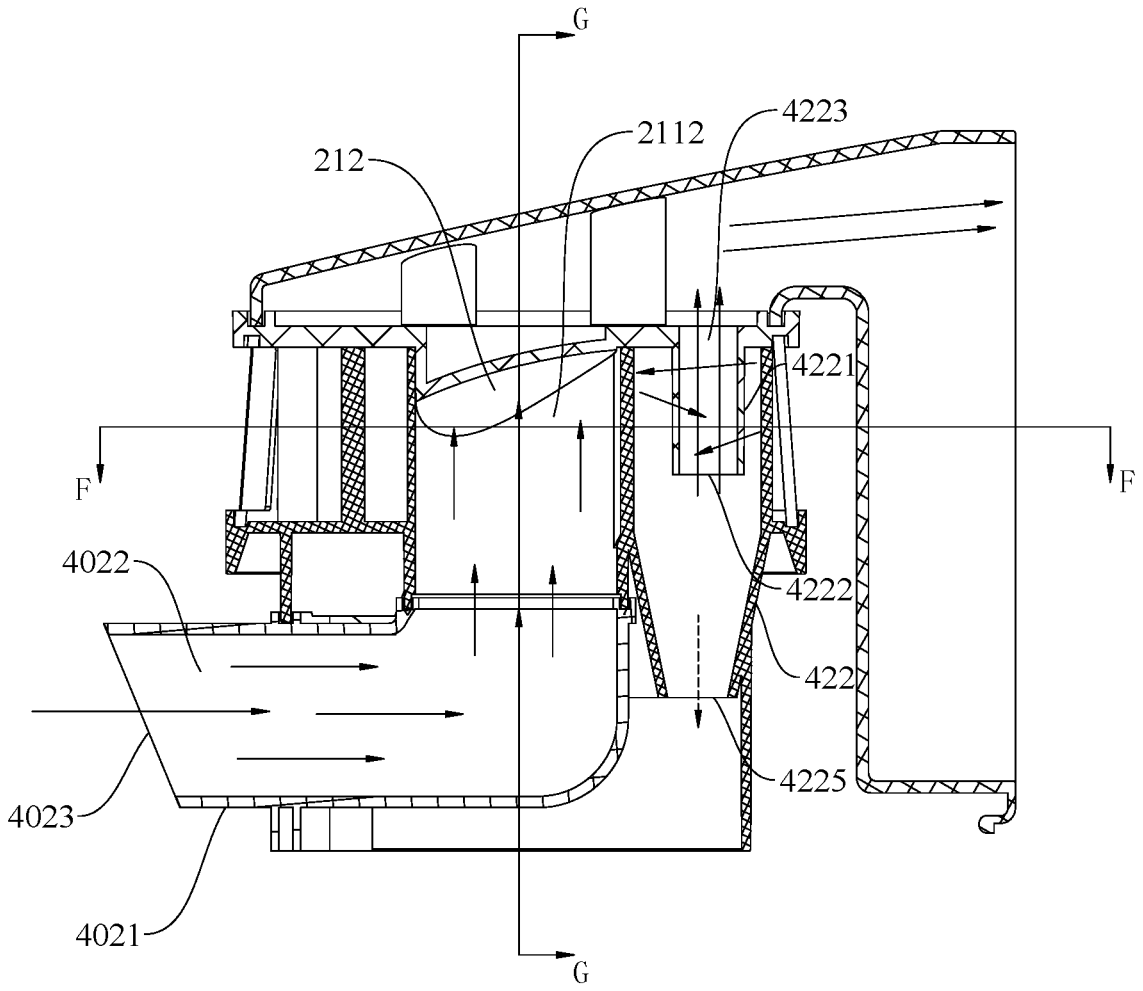
FIG. 29 is a longitudinally sectional view of a dust cup shown in FIG. 28.
Figure 30:
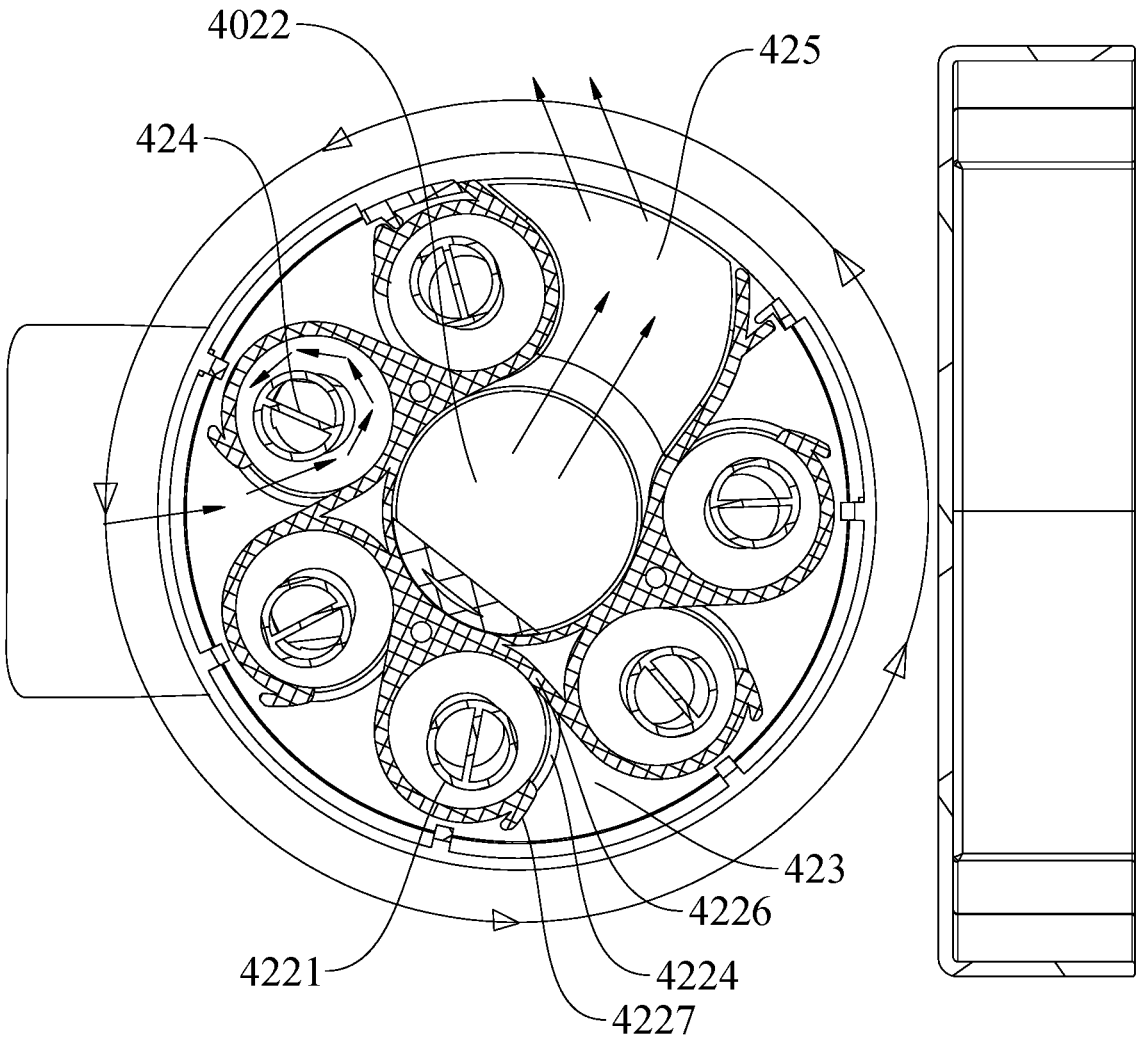
FIG. 30 is a sectional view along line F-F in FIG. 29.
Figure 31:
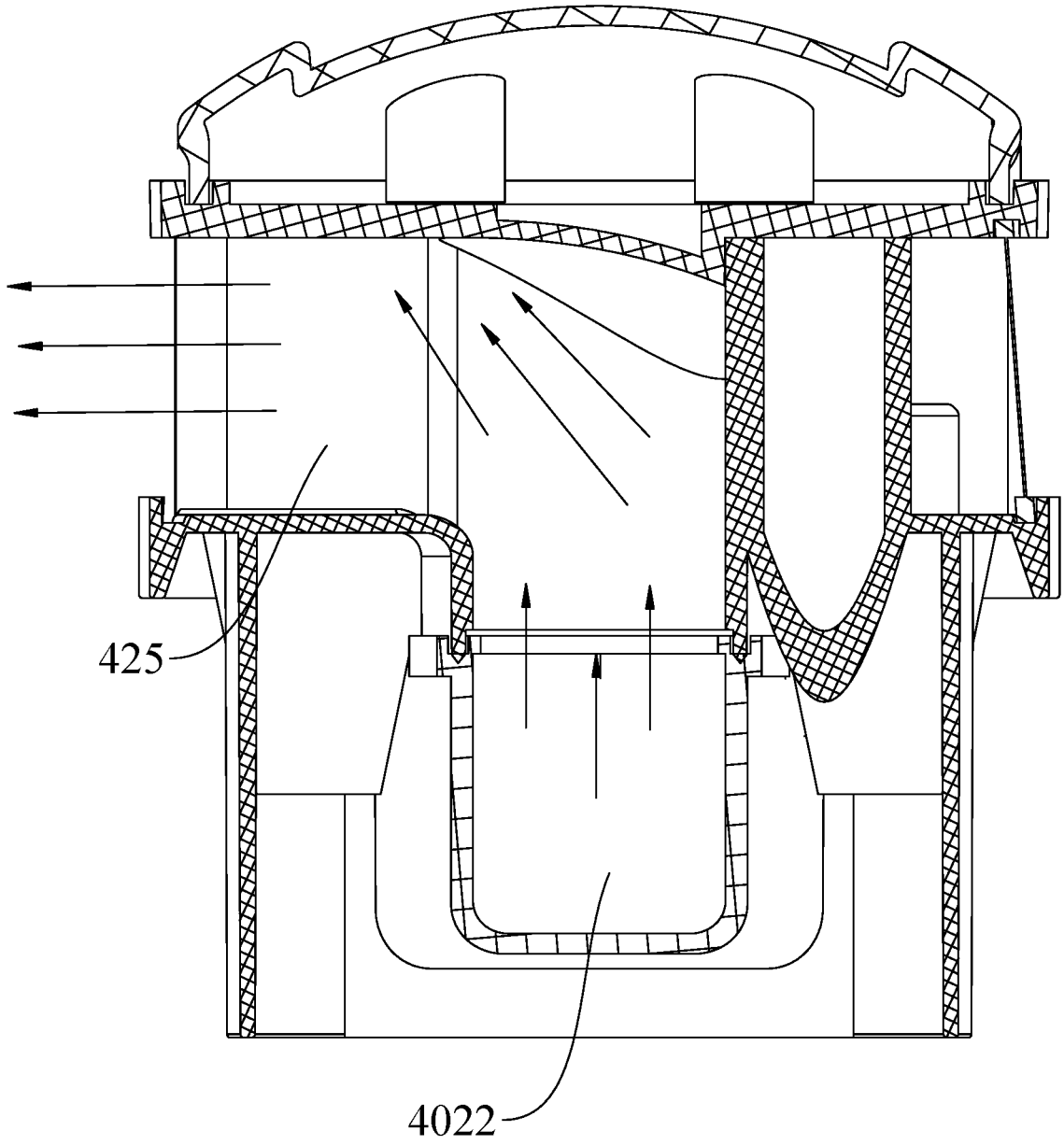
FIG. 31 is a sectional view along line G-G in FIG. 29.
Figure 32:
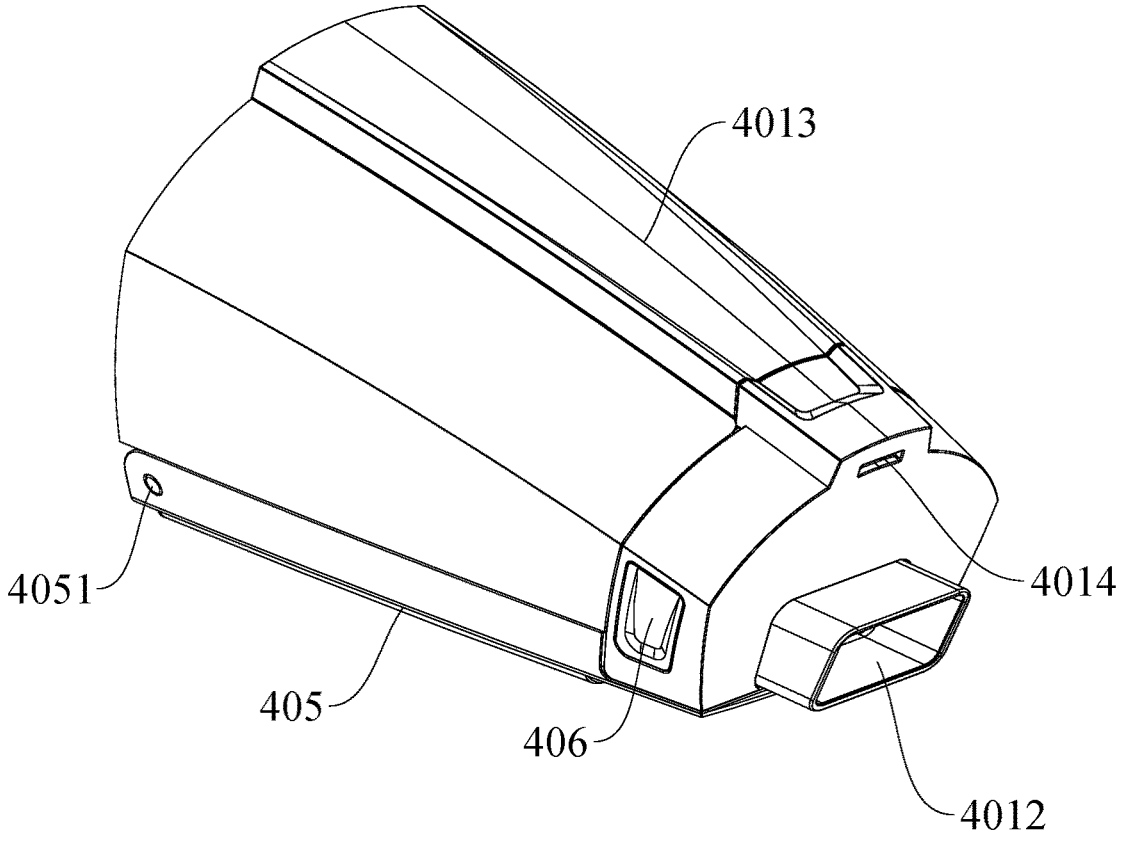
FIG. 32 is a schematic view of a front portion of a hand-held device shown in FIG. 25, in which an ash pouring plate is in a closed position.
Figure 33:
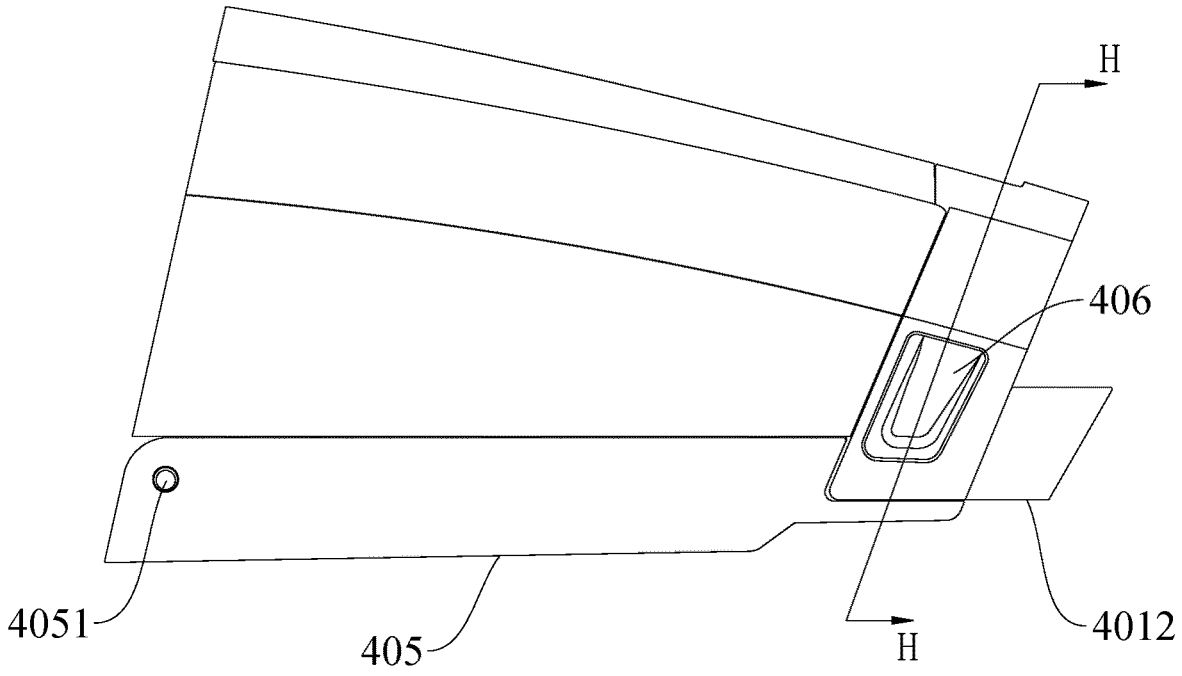
FIG. 33 is a side view of a front portion of a hand-held device shown in FIG. 32.
Figure 34:
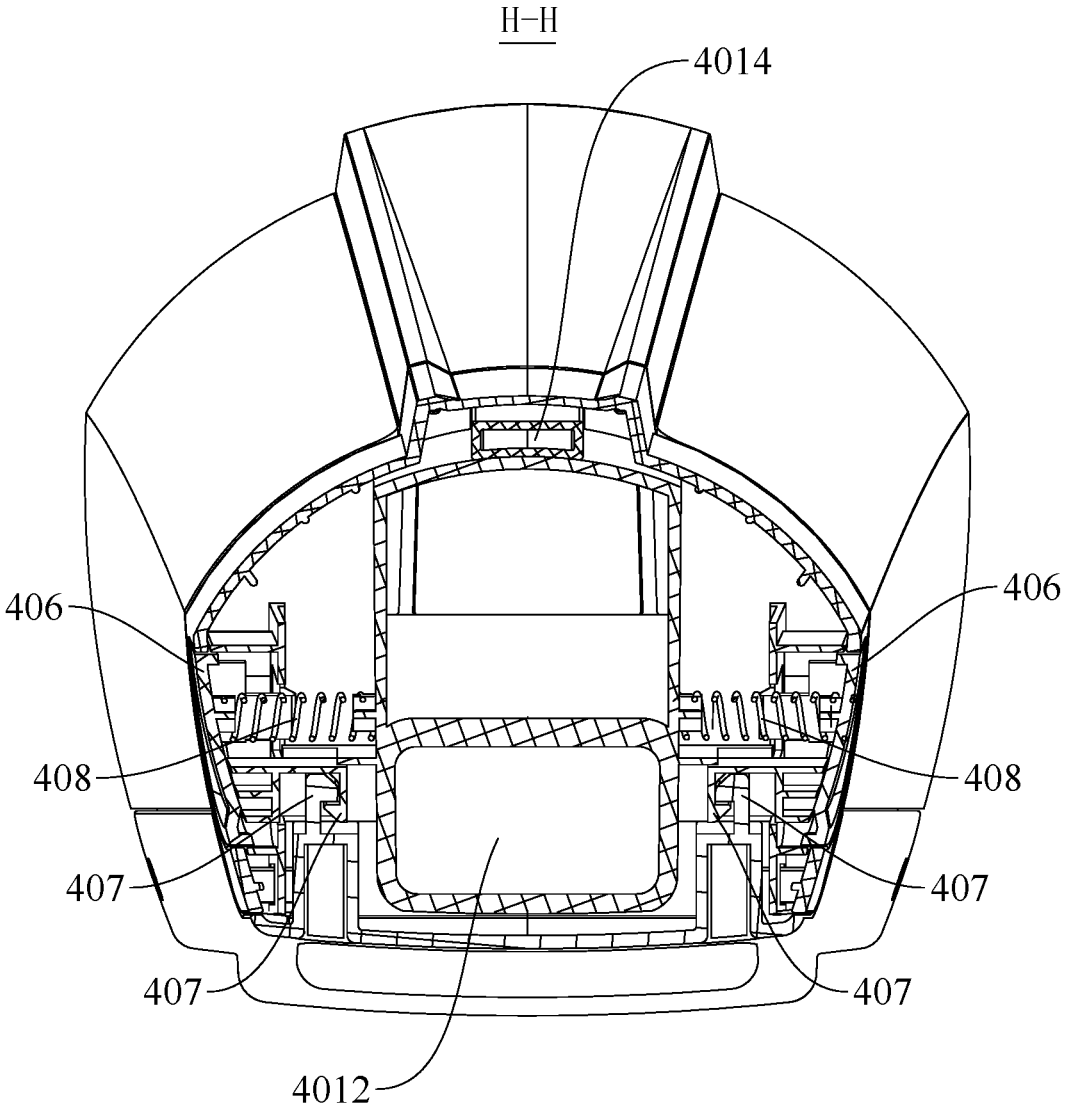
FIG. 34 is a sectional view along line H-H in FIG. 33.
Figure 35:
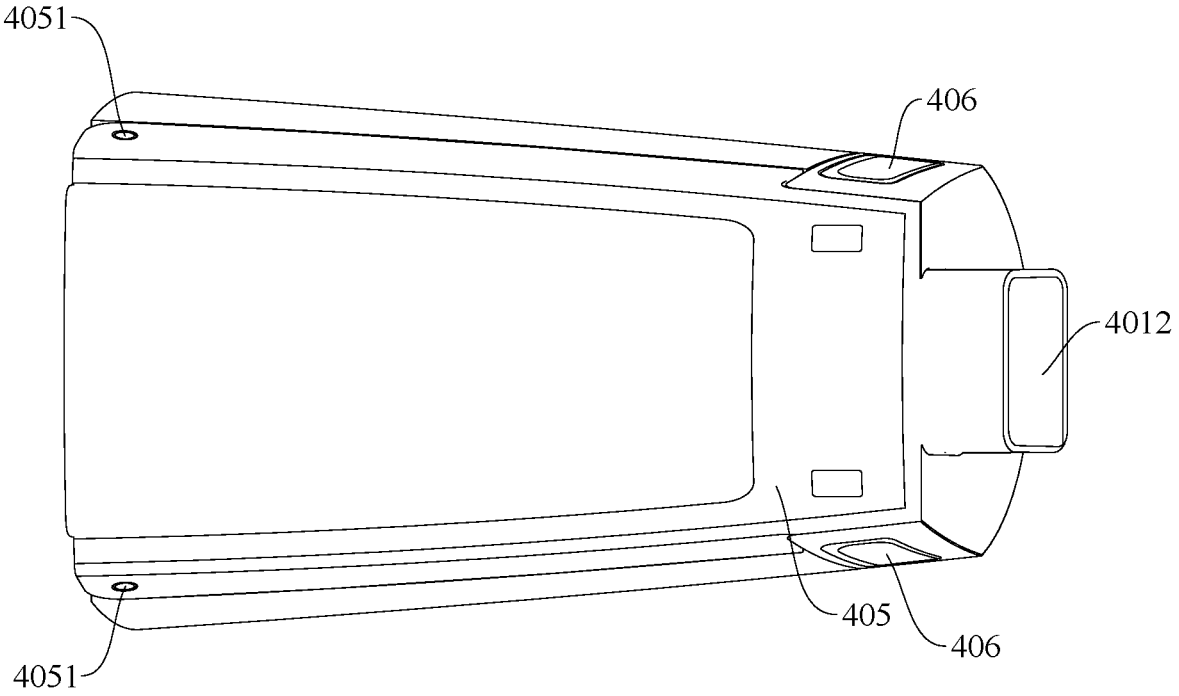
FIG. 35 is a bottom view of a front portion of a hand-held device shown in FIG. 32.
Figure 36:
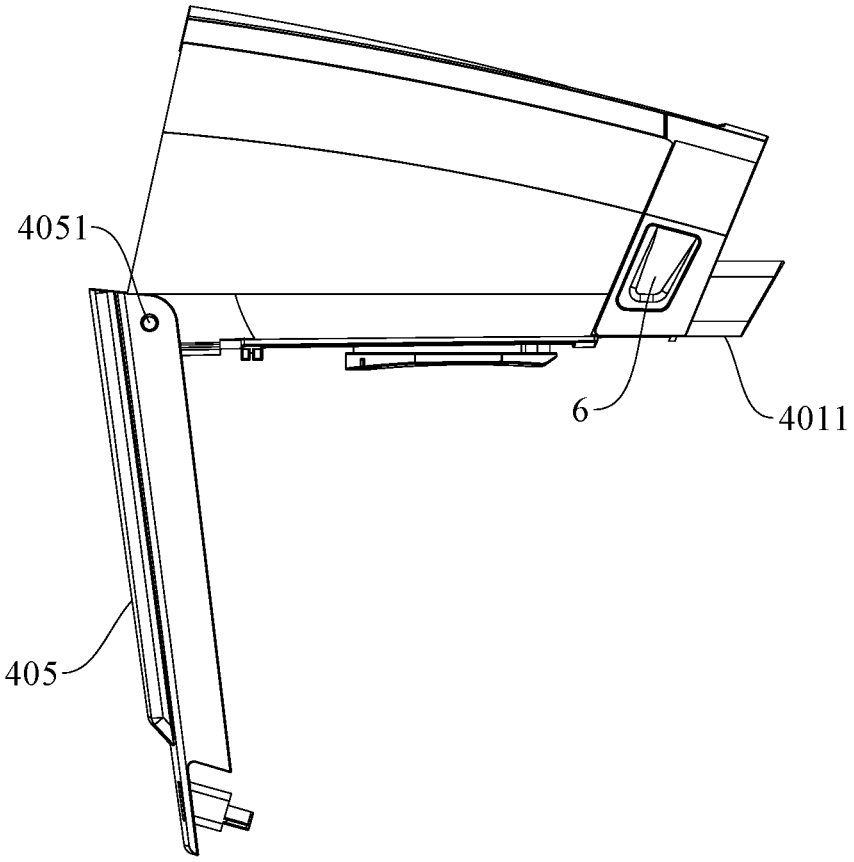
FIG. 36 is another schematic view of a front portion of a hand-held device shown in FIG. 32, in which an ash pouring plate is in an open position.
Figure 37:
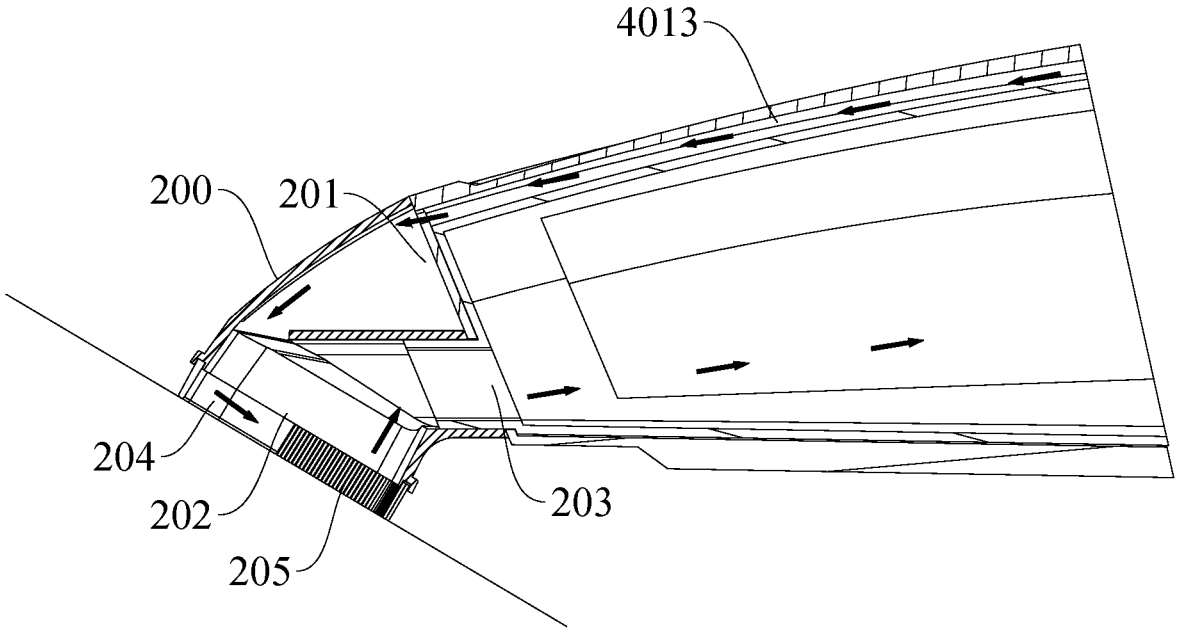
FIG. 37 is a schematic assembly view of a front portion of a hand-held device and a floor brush according to an embodiment of the present disclosure.

For example, with reference to FIGS. 23 and 24, the fitting tooth 221 has an outer contour of a substantial sector shape, the fitting tooth 221 also has a fitting hole therein, and a shape of a cross section of the fitting hole is substantially identical with the shape of the outer contour of the fitting tooth 221, i.e., the fitting tooth 221 is a hollow structure, thus saving materials, reducing the weight and reducing the cost. A shape of a cross section of the sub fitting groove 331 is matched with that of the fitting tooth 221.

Optionally, the retainer 33 may be connected to the machine body 1 via a snap or a threaded fastener, but not limited to this. For example, in an embodiment in FIG. 6, the retainer 33 has a mounting hole 333, and the threaded fastener (such as a bolt) passes through the mounting hole 333 so as to connect the retainer 33 to the machine body 1. Specifically, an internal thread may be formed in an inner wall of the mounting hole 333, an external thread configured to fit with the internal thread may be formed in an outer wall of the threaded fastener, and thus a simple structure is provided and it is easy to assemble.

Furthermore, a side surface of the lock catch 34 adjacent to the retainer 33 is provided with a guiding post 222, and a side surface of the retainer 33 adjacent to the lock catch 34 is provided with a guiding hole 332. When the guiding post 222 extends into the guiding hole 332, the plurality of fitting teeth 221 is fitted with the plurality of sub fitting grooves 331 respectively.

Figure 22:
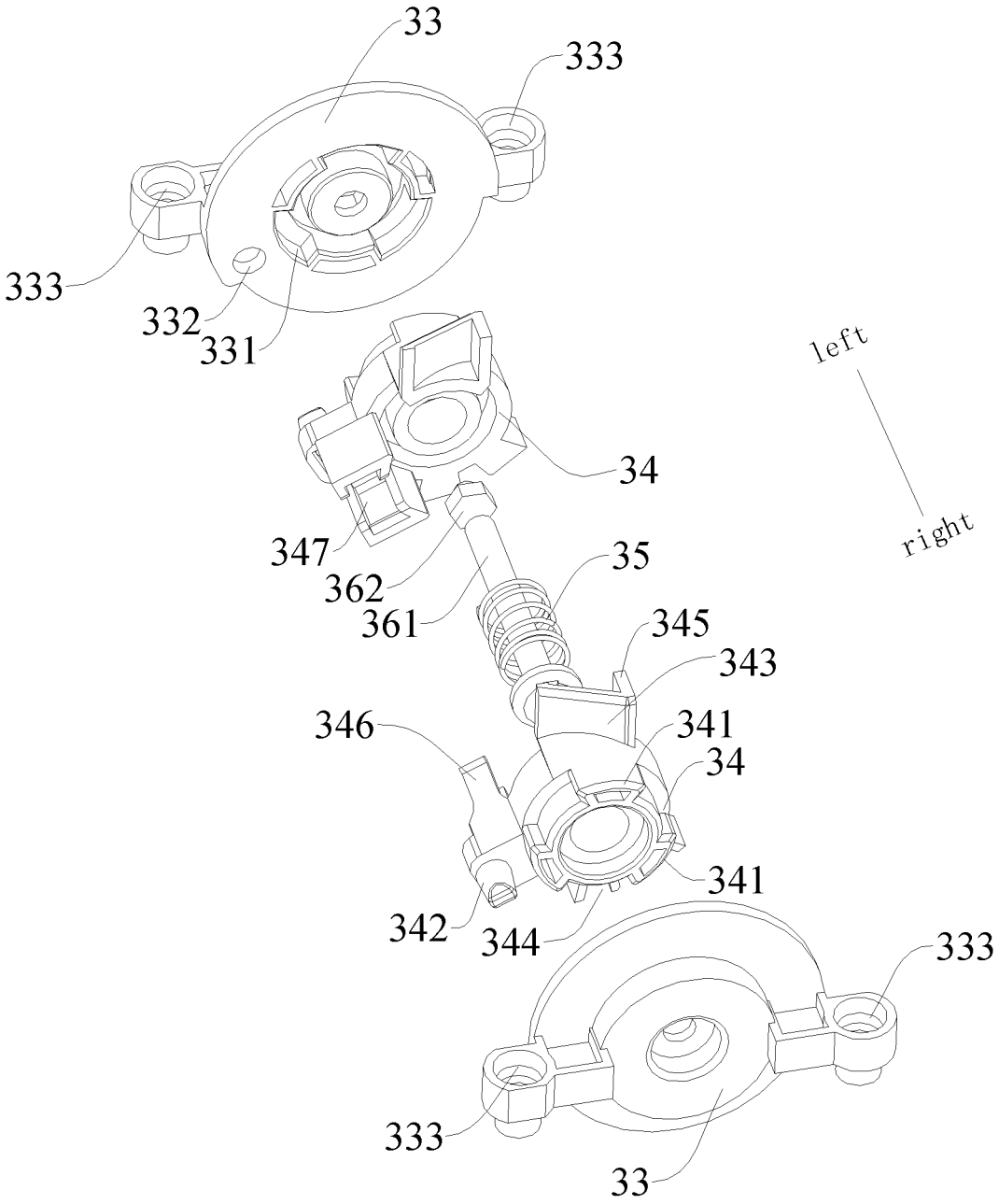
FIG. 22 is an exploded view of a lock catch assembly shown in FIG. 21.

For example, with reference to FIG. 22, in combination with FIG. 24, an end of the guiding post 222 is connected with the lock catch 34, and a free end of the guiding post 222 extends in a direction approaching the retainer 33. The guiding post 222 has a cross sectional area gradually decreased in the direction approaching the retainer 33. For example, in the embodiment in FIG. 24, the guiding post 222 is configured to have a substantial cone shape, the guiding hole 332 has a round cross section, and a cross sectional area of the guiding hole 332 is larger than a cross sectional area of the free end of the guiding post 222. Thus, it is easy for the guiding post 222 to extend into the guiding hole 332, so that it is convenient for the guiding post 222 to be fitted with the guiding hole 332.

Specifically, the free end of the guiding post 222 extends beyond a side surface of the fitting tooth 221 adjacent to the retainer 33. That is, only after the guiding post 222 firstly extends into the guiding hole 332 to be fitted with the guiding hole 332, can the fitting tooth 221 be fitted with the sub fitting groove 331. Thus, the fitting tooth 221 can be guided to fit with the sub fitting groove 331 by the guiding post 222 quickly and accurately.

Furthermore, a positioning member 24 is provided on an inner wall of the handle 1, and the lock catch 34 is provided with a positioning groove 344 configured to fit with the positioning member 24. For example, with reference to FIG. 21, in combination with FIGS. 22 and 24, the positioning member 24 is located at two sides of the separating plate 23 and in rear of the pivoting shaft 22, and the positioning groove 344 is provided on a rear portion of the lock catch 34. An end (for example, a rear end in FIG. 21) of the positioning member 24 is open, and the positioning member 24 has a cross section of a substantial trapezoid shape. During assembling, the positioning member 24 is fitted with the positioning groove 344 so as to prevent the lock catch 34 from rotating with respect to the handle 1 in the circumferential direction, so that a location of the handle 1 is stable.

Certainly, it may be understood that, the cross section of the positioning member 24 may have another shape, as long as the lock catch 34 can be prevented from rotating with respect to the handle 1 in the circumferential direction, which is not limited by the present disclosure.

Moreover, the vacuum cleaner 100 further includes a first resetting member 35, and the first resetting member 35 is disposed at a side of the lock catch 34 away from the retainer 33. The first resetting member 35 is configured to constantly push the lock catch 34 towards the retainer 33. For example, in an embodiment in FIG. 22, the first resetting member 35 has a first end abutting against a separating plate 23 and a second end abutting against the lock catch 34. Optionally, the first resetting member 35 may be configured as a spring, but not limited to this.

Furthermore, the vacuum cleaner 100 includes a pull rod 31, and the pull rod 31 is movably disposed in the handle 1. The pull rod 31 is fitted with the lock catch 34 so that the lock catch 34 is configured to be separably fitted with the retainer 33. Specifically, the pull rod 31 is provided with a pull rod button 311. For example, with reference to FIGS. 18, 19 and 21, the pull rod button 311 is disposed at an end of the pull rod 31 away from the machine body 1, a through hole is provided in the handle 1, and the pull rod button 311 extends out of the handle 1 through the through hole. Thus, it is convenient for the user to pull the pull rod button 311 with a finger.

For example, when the user pulls the pull rod button 311 with the finger, the pull rod 31 is moved along its length direction so as to drive the lock catch 34 to be separated from the retainer 33. At this time, the handle 1 can be rotated between the first position and the second position. When the pull rod button 311 is released, the guiding post 222 extends into the guiding hole 332, so as to guide the fitting tooth 221 to fit with the sub fitting groove 331, and thus the handle 1 is in the locking position.

Optionally, as shown in FIGS. 22-24, the lock catch 34 is provided with a first fitting block 345, and the first fitting block 345 has a first inclined surface 343. The pull rod 31 is provided with a second fitting block 324, and the second fitting block 324 has a second inclined surface 322 configured to fit with the first inclined surface 343. The first fitting block 345 is formed on a front portion of the lock catch 34, and the second fitting block 324 is disposed at a lower end of the pull rod 31. The first inclined surface 343 is in parallel with the second inclined surface 322, and a position limiting part is provided at an upper end of the first inclined surface 343. Thus, it is convenient for the first inclined surface 343 to fit with the second inclined surface 322, and the first inclined surface 343 and the second inclined surface 322 are prevented from moving with respect to each other in an upper and lower direction, so that locations of the lock catch 34 and the pull rod 31 are stable.

Specifically, two lock catch assemblies 2 are provided and bilaterally symmetrical with respect to a center of the pivoting shaft 22. At this time, a cross section of the second fitting block 324 may have a substantial trapezoid shape, the second fitting block 324 has two second inclined surfaces 322, and the second inclined surfaces 322 are located at right and left sides of the second fitting block 324 respectively. Optionally, the above two second inclined surfaces 322 are bilaterally symmetrical with respect to the center of the pivoting shaft 22. Thus, two first inclined surfaces 343 of two first fitting blocks 345 may be fitted with the two second inclined surfaces 322 of the second fitting block 324, so that the locations of the lock catch 34 and the pull rod 31 are more stable.

For example, when the pull rod 31 is moved along its length direction, with a fitting of the first inclined surface 343 and the second inclined surface 322, the two lock catches 34 can be moved along an axial direction of the pivoting shaft 22, so that the lock catch 34 is fitted with or separated from the retainer 33.

Furthermore, one of the two lock catches 34 of the two lock catch assemblies 2 is provided with a circumferential position limiting protrusion 346, and the other one thereof is provided with a circumferential position limiting groove 347 configured to fit with the circumferential position limiting protrusion 346. For example, in an embodiment in FIG. 5, the lock catch 34 at a right side of the pivoting shaft 22 is provided with the circumferential position limiting protrusion 346, the lock catch 34 at a left side of the pivoting shaft 22 is provided with the circumferential position limiting groove 347, and both of the circumferential position limiting groove 347 and the circumferential position limiting protrusion 346 extend in a left and right direction. A cross sectional area of a left end of the circumferential position limiting protrusion 346 is less than a cross sectional area of a right end of the circumferential position limiting protrusion 346, and thus it is convenient for the circumferential position limiting protrusion 346 to extend into the circumferential sub fitting grooves 331 quickly and accurately during assembling, so that it is ensured that the two lock catches 34 can rotate synchronously. The above two lock catches 34 are restricted onto the pivoting shaft 22, so that locations of the lock catches 34 are stable, and thus the vacuum cleaner 100 is easy to assemble.

Furthermore, with reference to FIGS. 21 and 22, the pivoting shaft 22 is configured as a hollow structure, and the vacuum cleaner 100 further includes a bolt 361 and a nut 362. During assembling, two first resetting members 35 may first be sleeved onto an outer surface of the pivoting shaft 22 from two ends of the pivoting shaft 22, then the two lock catches 34 are sleeved onto the pivoting shaft 22 from left and right sides respectively and the circumferential position limiting protrusion 346 of one lock catch 34 is inserted into the circumferential position limiting groove 347 of the other lock catch 34, subsequently two retainers 33 are sleeved onto the pivoting shaft 22 from the left and right sides respectively, finally the bolt 361 passes through the pivoting shaft 22 from left to right or from right to left, and the nut 362 is connected to the bolt 361, so as to prevent the respective parts fitted over the pivoting shaft 22 from falling off from the end of the pivoting shaft 22.

Specifically, as shown in FIGS. 18-21, the vacuum cleaner 100 includes the machine body 1, the handle 1, two lock catch assemblies 2, two springs and the pull rod 31. The handle 1 is pivotably connected to the machine body 1 via the pivoting shaft 22. With reference to FIG. 21, the separating plate 23 is provided at the lower end of the handle 1, the pivoting shaft 22 passes through the separating plate 23, and the pivoting shaft 22 is configured as a hollow structure.

The handle 1 is pivotable between the first position and the second position. When the handle 1 is in the first position, the handle 1 is at the front side of the machine body 1; when the handle 1 is in the second position, the handle 1 is at the rear side of the machine body 1.

Each lock catch assembly 2 includes the retainer 33 and the lock catch 34. The retainer 33 is disposed at the machine body 1, the lock catch 34 is sleeved on the pivoting shaft 22, and the lock catch 34 is configured to be separably fitted with the retainer 33. When the lock catch assembly 2 is in the locking position, the lock catch 34 is fitted with the retainer 33; when the lock catch assembly 2 is in the pivoting position, the lock catch 34 is separated from the retainer 33.

The lock catch 34 is provided with the plurality of fitting teeth 221 arranged in the circumferential direction and spaced from one another, and the retainer 33 is provided with the plurality of sub fitting grooves 331 arranged in the circumferential direction and spaced from one another. When the fitting tooth 221 is fitted with the sub fitting groove 331, the handle 1 is fixed in the locking position; when the fitting tooth 221 is separated from the sub fitting groove 331, the handle 1 can be rotated forwards or backwards, so that the handle 1 is pivotable between the first position and the second position.

The fitting tooth 221 has an outer contour of a substantial sector shape, and the fitting tooth 221 has a fitting hole. A shape of the cross section of the fitting hole is substantially identical with the shape of the outer contour of the fitting tooth 221, i.e., the fitting tooth 221 is a hollow structure, thus saving materials, reducing the weight and reducing the cost. A shape of a cross section of the sub fitting groove 331 is matched with that of the fitting tooth 221.

The guiding post 222 is provided on the side surface of the lock catch 34 adjacent to the retainer 33, and the guiding hole 332 is provided in the side surface of the retainer 33 adjacent to the lock catch 34. The end surface of the free end of the guiding post 222 extends beyond the side surface of the fitting tooth 221 adjacent to the retainer 33, and when the guiding post 222 extends into the guiding hole 332, the plurality of fitting teeth 221 is fitted with the plurality of sub fitting grooves 331. The guiding post 222 is configured to have a substantial cone shape, the guiding hole 332 has a round cross section, and a cross sectional area of the guiding hole 332 is larger than a cross sectional area of the free end of the guiding post 222. Thus, it is easy for the guiding post 222 to extend into the guiding hole 332, so that it is convenient for the guiding post 222 to be fitted with the guiding hole 332.

The positioning member 24 is provided on an inner side of the handle 1, and the lock catch 34 is provided with the positioning groove 344 configured to fit with the positioning member 24. With reference to FIG. 4 in combination with FIGS. 5 and 7, the positioning member 24 is located at left and right sides of the separating plate 23 and in rear of the pivoting shaft 22, and the positioning groove 344 is provided on a rear portion of the lock catch 34. A rear end of the positioning member 24 is open, and the positioning member 24 has a cross section of a substantial trapezoid shape. During assembling, the positioning member 24 is fitted with the positioning groove 344 so as to prevent the lock catch 34 from rotating with respect to the handle 1 in the circumferential direction, so that a location of the handle 1 is stable.

Figure 18:
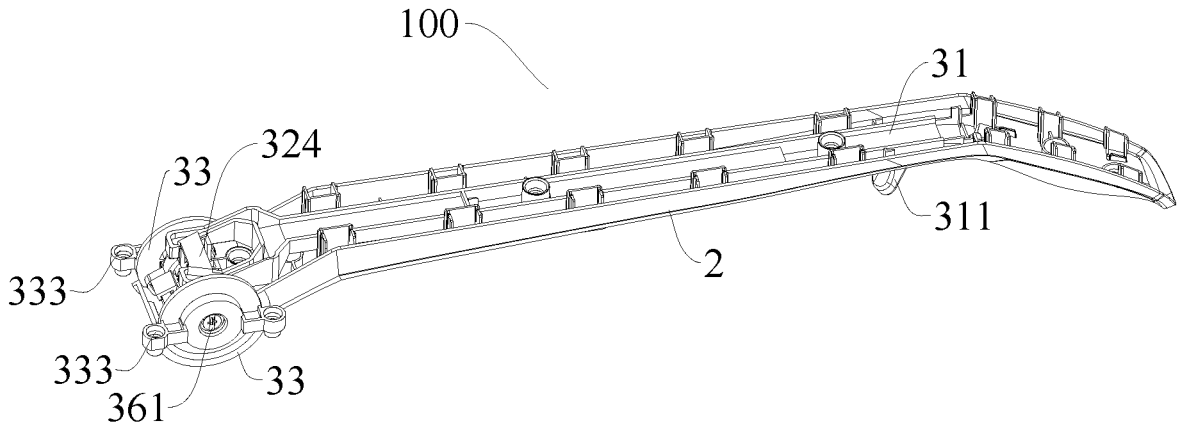
FIG. 18 is a schematic view of an inner structure of a handle of a vacuum cleaner according to an embodiment of the present disclosure.
Figure 19:
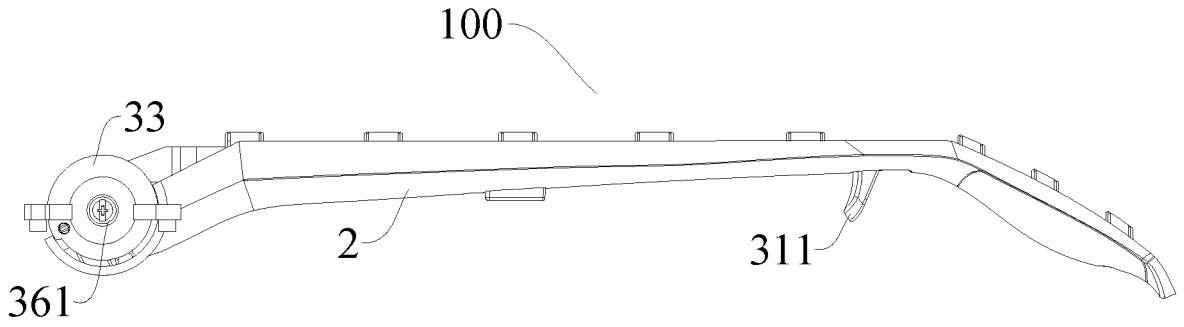
FIG. 19 is a front view of a handle shown in FIG. 1.
Figure 20:
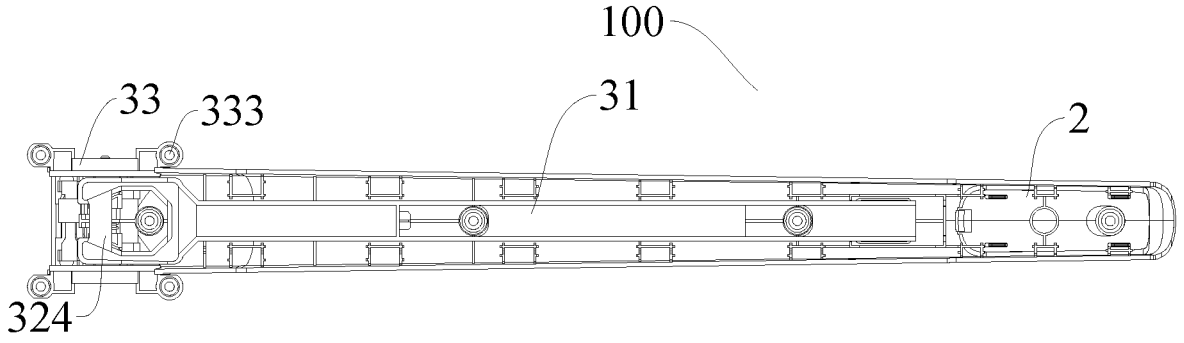
FIG. 20 is a top view of a handle shown in FIG. 1.

The spring has a first end abutting against the separating plate 23 and a second end abutting against the lock catch 34. The pull rod 31 is movably disposed within the handle 1, and the pull rod 31 is fitted with the lock catch 34 so that the lock catch 34 is configured to be separably fitted with the retainer 33. Specifically, the pull rod 31 is provided with the pull rod button 311. As shown in FIGS. 18, 19 and 21, the pull rod button 311 is disposed at the end of the pull rod 31 away from the machine body 1, the handle 1 has the through hole therein, and the pull rod button 311 may extends out of the handle 1 through the through hole. Thus, it is convenient for the user to pull the pull rod button 311 by the finger.

For example, when the user pulls the pull rod button 311 with the finger, the pull rod 31 is moved along its length direction so as to drive the lock catch 34 to be separated from the retainer 33. At this time, the handle 1 can be rotated between the first position and the second position. When the pull rod button 311 is released, the guiding post 222 extends into the guiding hole 332, so as to guide the fitting tooth 221 to fit with the sub fitting groove 331, and thus the handle 1 is in the locking position.

The lock catch 34 is provided with the first fitting block 345, and the first fitting block 345 has the first inclined surface 343. The pull rod 31 is provided with the second fitting block 324, the second fitting block 324 has a cross section of a substantial trapezoid shape and further has two second inclined surfaces 322, in which the two second inclined surfaces 322 are located at left and right sides of the second fitting block 324. The first fitting block 345 is formed on the front portion of the lock catch 34, the first inclined surface 343 is in parallel with the second inclined surface 322, and the position limiting part is provided at the upper end of the first inclined surface 343. Thus, it is convenient for the first inclined surface 343 to fit with the second inclined surface 322, and the first inclined surface 343 and the second inclined surface 322 are prevented from moving with respect to each other in the upper and lower direction, so that the locations of the lock catch 34 and the pull rod 31 are stable.

For example, when the pull rod 31 is moved along its length direction, with the fitting of the first inclined surface 343 and the second inclined surface 322, the two lock catches 34 can be moved along an axial direction of the pivoting shaft 22, so that the lock catch 34 is fitted with or separated from the retainer 33.

The lock catch 34 at the right side of the pivoting shaft 22 is provided with the circumferential position limiting protrusion 346, the lock catch 34 at the left side of the pivoting shaft 22 is provided with the circumferential position limiting groove 347, and both of the circumferential position limiting groove 347 and the circumferential position limiting protrusion 346 extend in the left and right direction. A cross sectional area of a left end of the circumferential position limiting protrusion 346 is less than a cross sectional area of a right end of the circumferential position limiting protrusion 346, and thus it is convenient for the circumferential position limiting protrusion 346 to extend into the circumferential sub fitting grooves 331 quickly and accurately during assembling, so that the above two lock catches 34 are restricted onto the pivoting shaft 22, the locations of the lock catches 34 are stable, and the vacuum cleaner 100 is easy to assemble.

Furthermore, with reference to FIGS. 21 and 22, the vacuum cleaner 100 further includes the bolt 361 and the nut 362. During assembling, two springs may first be sleeved onto an outer surface of the pivoting shaft 22 from two ends of the pivoting shaft 22, then the two lock catches 34 are sleeved onto the pivoting shaft 22 from left and right sides respectively and the circumferential position limiting protrusion 346 of one lock catch 34 is inserted into the circumferential position limiting groove 347 of the other lock catch 34, subsequently two retainers 33 are sleeved onto the pivoting shaft 22 from the left and right sides respectively, finally the bolt 361 passes through the pivoting shaft 22 from left to right or from right to left, and the nut 362 is connected to the bolt 361, so as to prevent the respective parts fitted over the pivoting shaft 22 from falling off from the end of the pivoting shaft 22.

With the vacuum cleaner 100 according to embodiments of the present disclosure, by making the handle 1 pivotable between the first position and the second position, the vacuum cleaner 100 is easy to use and assemble.

As shown in FIGS. 25-38, the vacuum cleaner further includes a hand-held device 400, and the hand-held device 400 includes a housing 401, a dust cup 402 and an electric motor 403.

The housing 401 has an air inlet 4012 and an air blowing port 4014, and the air blowing port 4014 is disposed adjacent to the air inlet 4012. The dust cup 402 is disposed in the housing 401, and the dust cup 402 is connected with the air inlet 4012. The electric motor 403 has a motor chamber 4031 therein, the motor chamber 4031 communicates with the dust cup 402, and an airflow entering from the air inlet 4012 flows out of the air blowing port 4014 after passing through the dust cup 402 and the electric motor 403.

For example, with reference to FIG. 1, in combination with FIGS. 8 and 10, the air inlet 4012 and the air blowing port 4014 each has a substantial rectangle shape, both the air inlet 4012 and the air blowing port 4014 are disposed at a front end of the housing 401 (for example, a left end in FIG. 1), and the air inlet 4012 is spaced apart from the air blowing port 4014. When the electric motor 403 operates, a negative pressure is generated in the motor chamber 4031, so that the external airflow with dust enters the dust cup 402 through the air inlet 4012. Under a filtering function of the dust cup 402, the dust is separated from the airflow and collected in dust cup 402, and the cleaned airflow passes through the motor chamber 4031 and is blown out of the air blowing port 4014. Herein, it should be noted that, direction "front" refers to a side of the hand-held device 400 away from the user, and an opposite direction of direction "front" is defined as direction "rear", i.e., a side of the hand-held device 400 held by the user.

Optionally, the air blowing port 4014 is disposed above the air inlet 4012, but not limited to this.

Optionally, the air blowing port 4014 has a cross sectional area less than a cross sectional area of the air inlet 4012. Thus, by providing the air blowing port 4014 having a relatively small size, the airflow blown out of the air blowing port 4014 may flow towards a surface to be cleaned at a certain flowing speed, so that the dust on the surface to be cleaned can be blown up effectively, and by providing the air inlet 4012 having a relatively large size, the dust blown up can be sucked into the dust cup 402 as much as possible, thus resulting in a great cleaning effect and a high cleaning efficiency.

As shown in FIG. 1, the dust cup 402 is in front of the electric motor 403. Certainly, the dust cup 402 may also be in rear of the electric motor 403 (not shown in figures), and the electric motor 403 is located between the air inlet 4012 and the dust cup 402 at this time, thus increasing structure diversity of the hand-held device 400. It may be understood that, specific locations of the dust cup 402 and the electric motor 403 can be adaptably adjusted according to actual requirements, which is not limited by the present disclosure.

When the hand-held device 400 is used to clean a structure having a narrow space such as a keyboard, the airflow blown out of the air blowing port 4014 may enter a narrow gap in the keyboard and blows up the dust in the narrow gap. Under the function of the negative pressure in the motor chamber 4031, the dust blown up may be sucked into the housing 401 through the air inlet 4012 and collected in the dust cup 402. Thus, it is excellently convenient to clean the structure having the narrow space such as the keyboard, saving both time and labor and resulting in a good cleaning effect.

With the hand-held device 400 according to embodiments of the present disclosure, by disposing the air blowing port 4014 and arranging the air blowing port 4014 adjacent to the air inlet 4012, it is excellently convenient to clean the narrow gap, and the good cleaning effect is provided.

According to an embodiment of the present disclosure, as shown in FIG. 1, the air blowing port 4014 obliquely extends towards the air inlet 4012. At this time, a central axis of the air blowing port 4014 intersects with that of the air inlet 4012, and an intersection point thereof is outside the housing 401. Preferably, the intersection point is on the surface to be cleaned (such as a surface of the keyboard, on which there is the dust). Therefore, the dust blown up by the air blowing port 4014 can be better sucked into the dust cup 402 by the air inlet 4012, and thus a better dust collecting effect can be achieved.

According to an embodiment of the present disclosure, an air inlet pipe 4011 is provided in the housing 401. For example, with reference to FIG. 1, the air inlet pipe 4011 extends horizontally, and an end (for example, a left end in FIG. 1, i.e., a free end) of the air inlet pipe 4011 extends out of the housing 401. The air inlet 4012 is formed at the free end of the air inlet pipe 4011, and the air inlet 4012 is at a front side of the air blowing port 4014.

Optionally, an end surface of the free end of the air inlet pipe 4011 obliquely extends in a direction running away from the air blowing port 4014 along a flowing direction of the airflow passing through the air inlet pipe 4011. For example, as shown in FIG. 1, the end surface of the left end of the air inlet pipe 4011 obliquely extends downwards along a direction from left to right. Thus, the airflow blown out of the air blowing port 4014 can be better blown to the surface to be cleaned, instead of returning to the dust cup 402 through the air inlet 4012 directly.

Furthermore, the end surface of the above free end of the air inlet pipe 4011 is configured as an inclined flat surface, and thus it is easy to produce at a low cost. Certainly, the end surface of the above free end of the air inlet pipe 4011 may also be configured as an inclined curved surface (not shown in figures), for example, as an inclined arc surface recessed towards a center of the housing 401.

According to an embodiment of the present disclosure, an air blowing channel 4013 is disposed in the housing 401, and the air blowing channel 4013 has a first end (for example, a right end in FIG. 1) communicating with the motor chamber 4031 and a second end (for example, a left end in FIG. 1) provided with the air blowing port 4014. Thus, the airflow in the motor chamber 4031 can be conveyed to the air blowing port 4014 through the air blowing channel 4013.

For example, as shown in FIG. 1, the air blowing channel 4013 is in a top portion of the housing 401, and extends in a front and rear direction (i.e., the right and left direction in FIG. 1). A rear end (i.e., the right end) of the air blowing channel 4013 communicates with the motor chamber 4031, and the air blowing port 4014 is formed at a front end (i.e., the left end) of the air blowing channel 4013 and located above the air inlet 4012. The air blowing channel 4013 obliquely extends downwards in a direction from rear to front, and at this time, a distance between the air blowing channel 4013 and the air inlet 4012 gradually decreases along the flowing direction of the airflow passing through the air blowing channel 4013, so that the air flow blown out of the air blowing port 4014 can be blown to the surface to be cleaned opposite to the air inlet 4012, and thus the dust blown up from the surface to be cleaned can be well sucked into the dust cup 402 through the air inlet 4012.

Optionally, the air blowing channel 4013 extends in the front and rear direction, as shown in FIG. 1, and thus, the airflow in the motor chamber 4031 can be better blown to the air blowing port 4014 through the linear air blowing channel 4013, so that the dust on the surface to be cleaned can be better blown up. Certainly, the air blowing channel 4013 may also extend in a curve (such as, a wavy line or an arc line) along the front and rear direction.

Furthermore, the air blowing channel 4013 preferably has a cross sectional area gradually decreased along the flowing direction of the airflow passing through the air blowing channel 4013, as shown in FIGS. 8 and 10. Thus, when the airflow flows through the air blowing port 4014, a flowing speed of the airflow can be improved, so that the airflow can flow to the surface to be cleaned at a higher flowing speed, so as to blow up the dust on the surface to be cleaned effectively.

It may be understood that, a specific location, shape and size of the air blowing channel 4013 may be set according to actual requirements, so as to meet the actual requirements better.

Optionally, respective pipes of the hand-held device 400 are connected with one another by ultrasonic soldering, in which "respective pipes" refer to respective independent pipes through which the airflow passes in the flowing direction of its own. For example, the air inlet pipe 4011 is connected with an air intake channel 4022 of a first cyclone of the dust cup 402 by ultrasonic soldering. Thus, the method of using the ultrasonic soldering has a fast soldering speed, a high soldering strength, and a good leakproofness.

According to an embodiment of the present disclosure, the housing 401 has an air outlet 4032. For example, in an embodiment shown in FIG. 1, the air outlet 4032 is located in a side of the electric motor 403 away from the air inlet 4012, and the air outlet 4032 communicates with the motor chamber 4031, so that the clean airflow may pass through the motor chamber 4031 and be discharged out of the air outlet 4032, after the airflow with dust entering through the air inlet 4102 is filtered in the dust cup 402.

The airflow entering through the air inlet 4012 flows out of at least one of the air outlet 4032 and the air blowing port 4014 after passing through the dust cup 402 and the electric motor 403. That is, the airflow entering through the air inlet 4012 may only flow out of the air outlet 4032 or the air blowing port 4014, and may also flow out of both the air outlet 4032 and the air blowing port 4014 simultaneously. For example, the airflow entering through the air inlet 4012 may switchably flow out of the at least one of the air outlet 4032 and the air blowing port 4014 by a switching mechanism 404 after passing through the dust cup 402 and the electric motor 403.

For example, when the hand-held device 400 operates normally (for example, cleaning a place having a large space, such as a bed sheet and a curtain), it is not required for the air blowing port 4014 to blow up the dust on the surface to be cleaned, and the air blowing port 4014 may be closed at this time. Under the function of the negative pressure in the electric motor 403, after the dust on the surface to be cleaned is sucked into the air inlet 4012 and filtered by the dust cup 402, the dust is collected in the dust cup 402, and the clean airflow passes through the motor chamber 4031 and is discharged out of the air outlet 4032.

When the hand-held device 400 is used to clean the structure having the narrow space such as the keyboard, the air blowing port 4014 may communicate with the motor chamber 4031, so that the airflow blown out of the air blowing port 4014 can be blown to the narrow gap of the keyboard and blow up the dust in the narrow gap. Under the function of the negative pressure in the electric motor 403, the dust blown up is sucked into the dust cup 402 through the air inlet 4012, then the dust cup 402 filters the airflow with dust sucked thereinto, the dust filtered out of the airflow is collected in the dust cup 402, and the clean airflow flows through the motor chamber 4031 and further to air blowing port 4014 so as to continue blowing up the dust on the keyboard. At this time, the air outlet 4032 may be closed completely. Certainly, the air outlet 4032 also may be opened slightly, but it should be ensured that a most part of the airflow flows to the air blowing port 4014.

According to an embodiment of the present disclosure, the air blowing port 4014 is communicatable with the motor chamber 4031, and a communication of the air blowing port 4014 and the motor chamber 4031 is switchable. When the air blowing port 4014 communicates with the motor chamber 4031, the airflow in the motor chamber 4031 may flow to the air blowing port 4014. When the air blowing port 4014 is partitioned from the motor chamber 4031, the airflow in the motor chamber 4031 cannot flow to the air blowing port 4014.

For example, the air blowing port 4014 is communicatable with the motor chamber 4031 via the switching mechanism 404, and the communication of the air blowing port 4014 and the motor chamber 4031 is switchable by the switching mechanism 404. The switching mechanism 404 is configured to be movable between a communicating position for communicating the air blowing port 4014 with the motor chamber 4031 and a partitioning position for partitioning the air blowing port 4014 from the motor chamber 4031. When the switching mechanism 404 is in the communicating position, the air blowing port 4014 communicates with the motor chamber 4031, the clean airflow may be blown onto the surface to be cleaned through the air blowing port 4014, and at this time, the hand-held device 400 can be used to clean the structure having the narrow space such as the keyboard. When the switching mechanism 404 is in the partitioning position, the air blowing port 4014 is partitioned from the motor chamber 4031, and thus the airflow in the motor chamber 4031 cannot be blown out of the air blowing port 4014.

When the switching mechanism 404 is in the communicating position, the switching mechanism 404 closes or semi-closes the air outlet 4032. The switching mechanism 404 closes the air outlet 4032, i.e., the switching mechanism 404 closes the air outlet 4032 completely, and the airflow in the motor chamber 4031 cannot flow out of the air outlet 4032; the switching mechanism 404 semi-closes the air outlet 4032, i.e., a part of the airflow in the motor chamber 4031 may flow out of air outlet 4032. Herein, it should be noted that, "semi-close" may be construed as a meaning that the switching mechanism 404 closes a part of the air outlet 4032, or that the switching mechanism 404 is close to the part of the air outlet 4032. At this time, most of the airflow in the motor chamber 4031 is blown out of the air blowing port 4014, and only a small part of the airflow flows out of the air outlet 4032. When the switching mechanism 404 is in the partitioning position, the air outlet 4032 communicates with the motor chamber 4031, so that the surface to be cleaned can be cleaned continuously when the hand-held device 400 operates normally.

Specifically, as shown in FIGS. 1-3, the switching mechanism 404 includes a push plate 4041. The push plate 4041 is movably disposed in the housing 401 and has a communicating opening 4042. When the switching mechanism 404 is in the communicating position, the communicating opening 4042 communicates the air blowing port 4014 with the motor chamber 4031.

For example, with reference to FIG. 1, in combination with FIGS. 2 and 3, the push plate 4041 may extend in the rear and front direction. For example, the push plate 4041 horizontally extends in the front and rear direction, so that the push plate 4041 is horizontally movable in the front and rear direction. The rear end of the air blowing channel 4013 is provided with an opening, and the opening is opposed to an opening of the motor chamber 4031 in an upper and lower direction, in which the opening of the motor chamber 4031 is configured to communicate with the air blowing channel 4013. At this time, the push plate 4041 is located between the opening of the rear end of the air blowing channel 4013 and the above opening of the motor chamber 4031. When the hand-held device 400 operates normally, the switching mechanism 404 is in the partitioning position, the communicating opening 4042 is staggered with the air blowing port 4014 and the motor chamber 4031, the push plate 4041 closes the above opening of the motor chamber 4031, and thus the push plate 4041 partitions the air blowing port 4014 from the motor chamber 4031, so that the airflow in the motor chamber 4031 will not be blown out of the air blowing port 4014 (as shown in FIG. 2). When it is required to clean the structure having the narrow space such as the keyboard, the push plate 4041 may be moved, so that the communicating opening 4042, the opening of the rear end of the air blowing channel 4013 and the above opening of the motor chamber 4031 are opposed to one another in the upper and lower direction, and thus the airflow in the motor chamber 4031 may enter the air blowing channel 4013 through the communicating opening 4042 and be blown out of the blowing port 4014.

The air outlet 4032 is formed in the motor chamber 4031 and located below the push plate 4041. As shown in FIGS. 2 and 3, the push plate 4041 is provided with a closing plate 4043, and the closing plate 4043 vertically extends downwards from a lower surface of the push plate 4041. The closing plate 4043 is opposed to the air outlet 4032, and the closing plate 4043 closes or semi-closes the air outlet 4032 when the switching mechanism 404 is in the communicating position. Furthermore, when the closing plate 4043 semi-closes the air outlet 4032, a gap is provided between the closing plate 4043 and the air outlet 4032, or the closing plate 4043 closes a part of the air outlet 4032. Thus, the producing accuracy of the closing plate 4043 is reduced and the cost is saved while the air blowing effect is ensured. Optionally, the closing plate 4043 is configured to have a thickness gradually increased from bottom to top, and thus the structure strength of the closing plate 4043 is ensured effectively.

Furthermore, the switching mechanism 404 further includes a spring 4045, the spring 4045 is disposed between the housing 401 and the push plate 4041, and the spring 4045 is configured to constantly push the push plate 4041 towards the partitioning position. Optionally, the spring 4045 is configured as a spring. For example, as shown in FIGS. 2 and 3, the spring is disposed between the electric motor 403 and the closing plate 4043 and located at a front side of the closing plate 4043, and the spring pushes the closing plate 4043 backwards, so that the push plate 4041 is constantly held in the partitioning position for partitioning the air blowing port 4014 from the motor chamber 4031. That is, the hand-held device 400 is often in a normal operation state.

In order to make the push plate 4041 move in the front and rear direction stably, each of the electric motor 403 and the closing plate 4043 is provided with a positioning post 4044, and two ends of the spring are sleeved onto corresponding positioning posts 4044 respectively. Optionally, a free end of the positioning post 4044 is configured to have a shape of a circular truncated cone, a cone or a semisphere, so as to mount the spring easily.

As shown in FIGS. 1-3, the push plate 4041 is provided with a push button 4046, and the push button 4046 is disposed on an upper surface of the push plate 4041 and is exposed out of an upper surface of the housing 401. Thus, the user can move the push plate 4041 between the communicating position and the partitioning position by pushing the push button 4046. Optionally, the push button 4046 is configured as a hollow structure, so as to save materials and reduce cost.

The hand-held device 400 is in the partitioning position shown in FIG. 2 in a normal state. At this time, the push plate 4041 partitions the air blowing port 4014 from the motor chamber 4031, the closing plate 4043 opens the air outlet 4032, and the push plate 4041 is kept in this position under an elastic force of the spring. When it is needed to clean the structure having the narrow space such as the keyboard, the push button 4046 may be pushed forwards so as to move the push plate 4041 forwards. When the push plate 4041 is moved to the communicating position, the communicating opening 4042 communicates the motor chamber 4031 with the air blowing channel 4013, and the closing plate 4043 is moved forwards to form a certain gap with respect to the air outlet 4032, so that most of the airflow in the motor chamber 4031 is blown out of the air blowing port 4014 through the air blowing channel 4013, thus cleaning the narrow gap well, and a small part of the airflow flows out of the air outlet 4032 through the gap between the air outlet 4032 and the closing plate 4043, as shown in FIG. 3.

Therefore, by providing the switching mechanism 404, in a case of ensuring the normal operation of the hand-held device 400, the airflow discharged out of the air outlet 4032 can be utilized effectively, thus further improving the cleaning effect of the hand-held device 400.

According to an embodiment of the present disclosure, as shown in FIGS. 4-7, the dust cup 402 includes: a cup body, a first cyclone, a cyclone assembly and a filter. The first cyclone, the cyclone assembly and the filter each is disposed in the cup body, the first cyclone has an air intake channel 4022, and the air intake channel 4022 has an air intake port 4023 and an air outtake port 4024.

With reference to FIGS. 5-7, the cyclone assembly includes a plurality of second cyclones 22, and the plurality of second cyclones 22 is arranged in parallel along a circumferential direction of the first cyclone, in which two of the plurality of second cyclones 22 define a guiding channel 425 therebetween, the guiding channel 425 communicates with the air outtake port 4024 and guides the airflow to an outer periphery of the cyclone assembly along a tangent line of a circumferential wall of the second cyclone 22 adjacent to the guiding channel 425, and a first cyclone separation space A configured for purification and separation of the airflow is formed between an outer circumferential wall of the cyclone assembly and an inner wall of the cup body. In this way, when the airflow to be purified enters through the air intake channel 4022 and is tangentially guided to the first cyclone separation space A through the guiding channel 425, the airflow may be separated for a first time, so that the particle or pollutant having a large size can be separated from the airflow and fall down. Specifically, the air intake channel 4022 has a first end communicating with the air inlet 4012 and a second end communicating with a first end of the guiding channel 425, a second end of the guiding channel 425 communicates with the first cyclone separation space A, and the airflow guided out by the guiding channel 425 enters the first cyclone separation space A along a tangential direction for the purification and separation of the airflow within the first cyclone separation space A.

As shown in FIG. 6, each second cyclone 22 has an air inducing notch 4224 so that the airflow can enter the second cyclone 22 along a tangential direction of the second cyclone 22. Each second cyclone 22 has an air guiding pipe 221 therein, and the air guiding pipe 221 is spaced apart from an inner circumferential wall of the second cyclone 22. The air guiding pipe 221 has an air guiding inlet 2211 and an air guiding outlet 2212, and the air guiding inlet 2211 communicates with the air inducing notch 4224, so that the airflow after the primary separation may enter the plurality of second cyclones 22 through the air inducing notches 4224, and may be discharged out of the air guiding pipe 221 after being further purified and separated in the second cyclones 22. The filter is disposed along the outer periphery of the cyclone assembly, so that the airflow at the outer periphery of the cyclone assembly can tangentially enter the second cyclone 22 through the filter and the air inducing notch 4224 (the second cyclone 22 defines a second cyclone separation space B therein). That is, the airflow is further purified and separated in the second cyclone separation space B. Thus, the airflow is purified and separated for the first time in the first cyclone separation space A, and the airflow after the primary separation passes through the filter and further enters the plurality of second cyclones 22 through the air inducing notches 4224, so as to be purified and separated for a second time. In the second cyclone separation space B, the airflow rotates around the air guiding pipe 221, the dust separated from the airflow drops down, and the airflow after the further purification enters the air guiding pipe 221 through the air guiding inlet 2211 and is discharged out of the second cyclone 22 through the air guiding outlet 2212.

Since the plurality of second cyclones 22 is arranged in parallel along the circumferential direction surrounding a longitudinal axis of the first cyclone, the airflow after the primary separation can be dispersed and parallelly enter the plurality of second cyclones 22, so as to go through the cyclone separations in the plurality of second cyclones 22 respectively.

Furthermore, an outlet filter is provided between the dust cup 402 and the electric motor 403. As shown in FIG. 1, the outlet filter is located at an outlet of the dust cup 402, downstream of the plurality of second cyclones 22. Thus, the airflow purified and separated again by the plurality of second cyclones 22 can be further purified by the outlet filter. Herein, it should be noted that, "downstream" may be construed as being downstream of the flowing direction of the airflow flowing through the dust cup 402.

Optionally, the filter may be configured as a high efficiency particulate air (HEPA) filter or a filter cotton.

Thus, by using the cyclone separation technology to purify and separate the airflow with dust entering the dust cup 402, the flowing smoothness of the airflow in the dust cup 402 is effectively ensured. Moreover, by disposing the first cyclone, the filter and the plurality of second cyclones 22 and performing a two-stage cyclone separation with the first cyclone and the plurality of second cyclones 22, the large particles or pollutants are first filtered out of the airflow by the first cyclone and the filter, then most small particles (such as dust particles) are filtered out of the airflow after the primary separation by the plurality of second cyclones 22, and finally a little fine dust is filtered out of the airflow by the outlet filter, thus resulting in a great dust-air separation effect.

The filter is configured to purify the airflow when the airflow flows to the second cyclone separation space B from the first cyclone separation space A. Preferably, the filter is detachably disposed at the outer periphery side of the cyclone assembly, so that the filter can be disassembled after being used for a period and thus it is convenient to clean the filter.

By providing the air guiding pipe 221 in the second cyclone 22, a period of time of the airflow staying in the second cyclone 22 is prolonged, so that the airflow to be cleaned in the second cyclone 22 can be cleaned better.

Optionally, as shown in FIGS. 5 and 6, the air guiding pipe 221 is eccentrically disposed with respect to the second cyclone 22. That is, a central axis of the air guiding pipe 221 is offset with respect to a central axis of the second cyclone 22, and the central axis of the air guiding pipe 221 does not coincide with the central axis of the second cyclone 22. In other words, an outer circumferential wall of air guiding pipe 221 is away from a part of an inner circumferential wall of the second cyclone 22, but is close to another part of the inner circumferential wall of the second cyclone 22, so that the airflow after the primary separation may first tangentially enter the part of the inner circumferential wall of the second cyclone 22 through the air inducing notch 4224, in which the part of the inner circumferential wall of the second cyclone 22 is away from the outer circumferential wall of air guiding pipe 221, then rotates around the air guiding pipe 221 to the other part of the inner circumferential wall of the second cyclone 22, in which the other part of the inner circumferential wall of the second cyclone 22 is close to outer circumferential wall of air guiding pipe 221, and thus it is ensured that the airflow entering the second cyclone 22 rotates in a same direction (for example, a counter-clockwise direction shown in FIG. 6) so as to be purified and separated.

For example, as shown in FIGS. 5 and 6, the air guiding pipe 221 is configured as a circular pipe and extends in a vertical direction. The air guiding pipe 221 is located in an upper portion of the second cyclone 22, and has an upper end connected with a top wall of the second cyclone 22 and provided with the air guiding outlet 2212, and a lower end provided with the air guiding inlet 2211. The air inducing notch 4224 is located at the upper portion of the second cyclone 22. The airflow entering the second cyclone 22 starts to rotate around an upper end of the air guiding pipe 221 and gradually moves downwards (as shown in FIG. 5), so as to generate a rotating and descending airflow, the rotating and descending airflow changes into an ascending airflow when descending to the lower end of the air guiding pipe 221, then the dust is separated from the airflow and drops down, and the clean airflow enters the air guiding pipe 221 and is discharged out of the air guiding outlet 2212 at the upper end of the air guiding pipe 221.

Furthermore, as shown in FIG. 6, the air guiding pipe 221 has a partition plate 424 therein, and the partition plate 424 separates interior of the air guiding pipe 221 into two chambers. Thus, by disposing the partition plate 424, the dust can further be separated from the airflow entering the air guiding pipe 221. Optionally, the partition plate 424 is vertically or obliquely disposed in the air guiding pipe 221.

A rotation direction of the airflow at the outer periphery of the cyclone assembly preferably is the same with that of the airflow in the second cyclone 22. As shown in FIG. 6, the airflow at the outer periphery of the cyclone assembly and the airflow in the second cyclone 22 after subsequently entering the second cyclone 22 both rotate in the counter-clockwise direction. Thus, the airflow in the dust cup 402 can be prevented from being disordered, so as to ensure a great separating effect of the dust cup 402.

As shown in FIG. 6, the filter is arranged around the cyclone assembly and has a relief opening therein, and the relief opening is opposed to the guiding channel 425. Thus, the airflow passing through the guiding channel 425 may directly flow towards the outer periphery of the cyclone assembly through the relief opening, however the airflow needs to pass through the filter first before flowing into the second cyclone 22, so that the smoothness of the airflow flowing is ensured while the filtering effect is ensured. In some embodiments, the filter may have a substantial C shape.

Certainly, a plurality of filters may be provided and arranged to be corresponding to the air inducing notches 4224 of the plurality of second cyclones 22. Each filter corresponds to one or more air inducing notches 4224, and thus the airflow after the primary separation in the first cyclone separation space A tangentially enters the second cyclone 22 through the air inducing notch 4224 directly to be separated after passing through the filter, so that the large particles are first filtered out of the airflow before the airflow is separated again in the second cyclone 22, thereby further improving the separating and purifying effect.

Optionally, the above filter may be configured as a filter net (not shown in figures). Certainly, the filter may also be configured as an insert having filtering holes. Meshes of the filter net or the filtering holes may be distributed in a form of multiple layers of circular rings, or homogeneously distributed in multiple rows and columns, in order for a homogeneous filtering. In addition, sizes of the meshes of the filter net or the filtering holes are not limited. A relatively small size results in the great filtering effect, and a relatively large size causes high air exhaust efficiency and a low energy loss of the electric motor 403. In actual applications, an appropriate size may be selected according to a requirement for performance of a product.

As shown in FIG. 6, a connecting wall 4226 is connected to a first side of the air inducing notch 4224 of each second cyclone 22, in which the connecting wall 4226 is tangent to a side wall of the second cyclone 22, and an extending part 4227 extends out from a second side of the air inducing notch 4224 of the second cyclone 22, and the extending part 4227 and the connecting wall 4226 define a tangential air inducing channel 423 therebetween. Optionally, the connecting wall 4226 on the second cyclone 22 extends to and is tangentially connected to the side wall of the adjacent second cyclone 22, in which the extending part 4227 extends towards a corresponding connecting wall 4226 along the flowing direction of the airflow passing through the air inducing channel 423. At this time, the air inducing channel 423 is configured to have a width gradually decreased along the flowing direction of the airflow passing through the air inducing channel 423. Thus, the airflow at the outer periphery of the cyclone assembly may smoothly enter the second cyclone 22 through the air inducing channel 423 along the tangential direction of the second cyclone 22, so as to go through the cyclone separation, thus providing a great separating effect.

As shown in FIGS. 5 and 7, an inner wall of an end of the air intake channel 4022 has a guiding surface configured to guide the airflow in the air intake channel 4022 to the guiding channel 425, in which the air outtake port 4024 is provided in the end of the air intake channel 4022. Thus, the airflow passing through the air intake channel 4022 can be well guided to the guiding channel 425 under a function of the guiding surface. For example, with reference to FIGS. 5 and 7, the air intake channel 4022 is defined by an air intake pipe 4021, and the air intake port 4023 and the air outtake port 4024 of the air intake channel 4022 are defined by upper and lower ends of the air intake pipe 4021 respectively. The air intake pipe 4021 includes a horizontal pipe segment and a vertical pipe segment connected with each other, a free end (for example, a left end in FIG. 5) of the horizontal pipe segment communicates with the air inlet 4012, a free end (for example, an upper end in FIG. 5) of the vertical pipe segment communicates with the guiding channel 425, and the guiding surface is located at a top wall of the free end of the vertical pipe segment, so that the airflow can be well guided to the guiding channel 425 under the function of the guiding surface when flowing by the guiding surface. For example, the guiding surface preferably is configured as an arc surface.

Optionally, as shown in FIG. 6, the guiding channel 425 is configured to have a width gradually increased along the flowing direction of the airflow. Thus, the airflow flowing through the guiding channel 425 can be well guided to the outer periphery of the cyclone assembly under a guiding function of the guiding channel 425.

Optionally, each second cyclone 22 has an opening 4225 in a bottom thereof, the small particles separated by the second cyclone 22 may drop down to a place below the second cyclone 22 through the opening 4225 of the second cyclone 22, so that it is convenient to collect the small particles and the separated small particles cannot be blown up when the airflow is going through the cyclone separation in the second cyclone 22.

Respective parts of the dust cup 402 may be connected with one another by ultrasonic soldering.

Thus, by using the above dust cup 402, the dust-air separation function of the dust cup 402 is improved, most dust is thrown out of the airflow before the airflow flows to the outlet filter, and only a little dust enters the outlet filter, so that the outlet filter can be prevented from being blocked by a great deal of dust, and thus a cleaning cycle of the outlet filter is deceased, a working life of the outlet filter is improved, and meanwhile a burden of the electric motor 403 is also reduced.

According to an embodiment of the present disclosure, a bottom of the first cyclone separation space A is opened to form an opening, and each second cyclone 22 has the above opening 4225 in the bottom thereof. The dust cup 402 has a dust outlet in a bottom thereof, and the dust outlet is constituted by the opening in the bottom of the first cyclone separation space A and the opening 4225 in the bottom of the second cyclone 22 together.

Figure 9B:
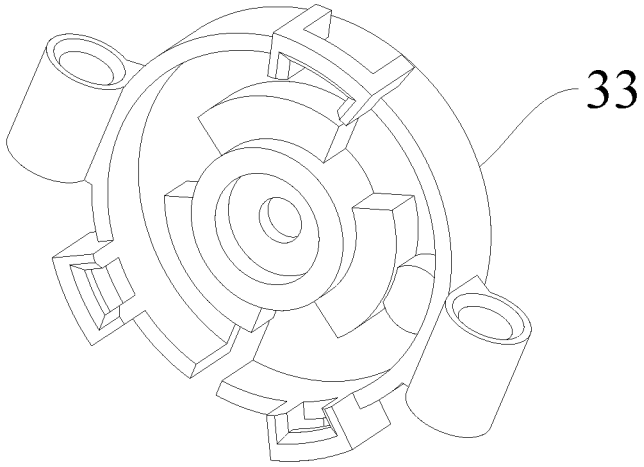
FIG. 9*b* is another schematic view of a retainer shown in FIG. 7.

As shown in FIGS. 8-12, the hand-held device 400 further includes an ash pouring plate 405, and the ash pouring plate 405 is disposed at a bottom of the housing 401. The ash pouring plate 405 is configured to be movable between an open position for opening the dust outlet and a closed position for closing the dust outlet. When the ash pouring plate 405 is in the open position, the dirt and dust in the dust cup 402 can be discharged through the dust outlet (as shown in FIGS. 8 and 9); when the ash pouring plate 405 is in the closed position, the ash pouring plate 405 closes the bottom of the dust cup 402 to ensure the dust cup 402 to work normally (as shown in FIG. 12).

Thus, by providing the ash pouring plate 405, the dirt and dust in the dust cup 402 can be poured out easily, thus greatly simplifying an ash pouring procedure.

Specifically, with reference to FIGS. 8-12, a first end of the ash pouring plate 405 is pivotably connected to the housing 401 so that the ash pouring plate 405 is rotatable between the open position and the closed position, and a second end of the ash pouring plate 405 is configured to be separably fitted with the housing 401. For example, the ash pouring plate 405 extends in the front and rear direction, a rear end of the ash pouring plate 405 is pivotably connected to the housing 401 via a pivoting rod 4051, and a front end of the ash pouring plate 405 is configured to be separably fitted with the housing 401.

As shown in FIGS. 9 and 10, the second end of the ash pouring plate 405 is configured to be separably fitted with the housing 401 via at least one fitting structure. The fitting structure includes a first fitting member and a second fitting member, the first fitting member is disposed at the second end of the ash pouring plate 405, and the second fitting member is disposed at the housing 401. When the ash pouring plate 405 is in the open position, the first fitting member is separated from the second fitting member; when the ash pouring plate 405 is in the closed position, the first fitting member is fitted with the second fitting member. Optionally, the first fitting member and the second fitting member are configured as snaps 407 configured to be buckled with each other.

When the above two snaps 407 are buckled with each other, the ash pouring plate 405 is kept in the closed position, so that the hand-held device 400 can work normally, the dust cup 402 can purify and separate the airflow to be cleaned entering through the air inlet 4012, and the dirt and dust separated from the airflow are collected at the bottom of the dust cup 402. When the hand-held device 400 finishes operating, the two snaps 407 are separated from each other, so that the ash pouring plate 405 can be rotated to the open position from the closed position, and the dirt and dust collected in the dust cup 402 can directly fall out of the housing 401 through the dust outlet.

Furthermore, as shown in FIGS. 8-12, the hand-held device 400 further includes a press button 406, the press button 406 is disposed in housing 401, and the second fitting member is disposed on the press button 406. When the press button 406 is pressed down, the second fitting member moves away from the first fitting member so as to be separated from the first fitting member. For example, with reference to FIG. 10, an extending plate horizontally extending towards a center of the housing 401 is provided on an inner surface (i.e., a surface adjacent to the center of the housing 401) of the press button 406, and the second fitting member (such as the snap 407) is disposed at a free end of the extending plate. During a process of pressing down the press button 406, the second fitting member moves towards the center of the housing 401 and finally is separated from the first fitting member, so that the front end of the ash pouring plate 405 is rotated downwards due to its own gravity to open the dust outlet.

As shown in FIG. 10, an elastic element 408 is provided between the press button 406 and the dust cup 402 and configured to constantly push the press button 406 in a direction running away from the center of the housing 401. Optionally, the elastic element 408 is configured as a spring. Therefore, when the ash pouring plate 405 is in the closed position, under an elastic force of the elastic element 408 (such as the spring), the first fitting member is always fitted with the second fitting member, so that the ash pouring plate 405 is kept in the closed position.

Optionally, two fitting structures are provided, and the two fitting structures are bilaterally symmetrical. Thus, the connection reliability of the ash pouring plate 405 can be ensured efficiently.

Furthermore, a sealing member is disposed between the ash pouring plate 405 and the dust outlet so as to seal a gap between the ash pouring plate 405 and the dust outlet. Thus, by providing the sealing member, the leakproofness at the dust outlet can be further ensured.

Figure 13:
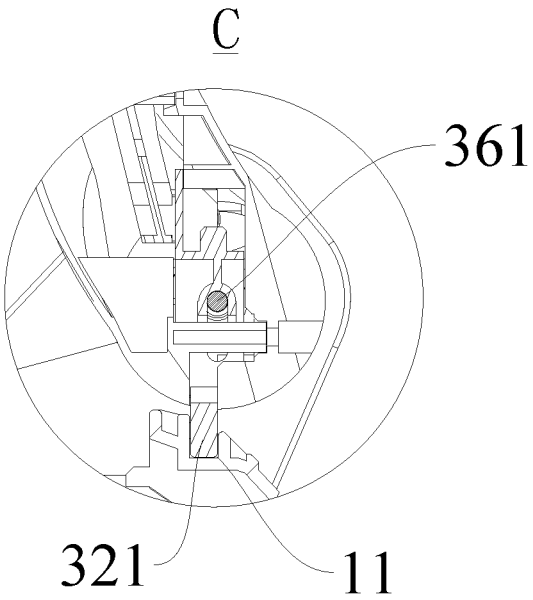
FIG. 13 is an enlarged view of portion C circled in FIG. 12.

According to an embodiment of the present disclosure, as shown in FIG. 13, the above hand-held device 400 may be used with a floor brush 200, such as a pet brush. In following descriptions of the present disclosure, the pet brush is taken as an example to illustrate the floor brush 200. Certainly, those skilled in the related art may understand that, the floor brush 200 may also be another type of floor brush 200, but not limited to the pet brush.

Specifically, the floor brush 200 (such as the pet brush) has a floor brush inlet 201, a floor brush outlet 203 and a floor brush opening 202. The floor brush inlet 201 communicates with the air blowing port 4014 of the hand-held device 400, the floor brush outlet 203 communicates with the air inlet 4012 of the hand-held device 400, the floor brush opening 202 is located at a side of the floor brush 200 away from the housing 401, and thus the airflow blown out of the air blowing port 4014 first flows through the floor brush inlet 201 to the floor brush opening 202, and then flows through the floor brush outlet 203 to the air inlet 4012. In other words, the airflow blown out of the air blowing port 4014 may first flow through the floor brush inlet 201 and the floor brush opening 202 in turn to a place in which hair of a pet (such as a dog and a cat) is, so as to blow up the hair and dust falling off from the skin, and then the airflow passes through the floor brush opening 202 and the floor brush outlet 203 and enters the hand-held device 400 through the air inlet 4012. Optionally, the floor brush 200 is detachably connected with the housing 401.

Thus, by using the above hand-held device 400 with the floor brush 200 such as the pet brush, the surface to be cleaned, such as the hair and skin of the pet, can be cleaned well, and thus a great cleaning effect can be achieved.

The floor brush 200 has an air intake passage, the floor brush inlet 201 is formed at a free end of the air intake passage, and the air intake passage has a cross sectional area gradually decreased along the flowing direction of the airflow. Thus, the airflow can flow to the surface to be cleaned at a certain flowing speed, so that the dust on the surface to be cleaned can be blown up better.

As shown in FIGS. 1 and 13, the air inlet 4012 is formed at a free end (for example, a left end in FIGS. 1 and 13) of the air inlet pipe 4011, the air inlet pipe 4011 extends out of the housing 401, and the free end of the air inlet pipe 4011 is connected with the floor brush outlet 203 by inserting connection. Thus, by means of inserting connection, it is convenient for mounting, and a high assembling efficiency is provided.

With reference to FIG. 13, a baffle 204 is provided at a side of the floor brush opening 202, in which the side of the floor brush opening 202 is close to or at the air blowing port 4014. Thus, by providing the baffle 204, the baffle 204 has a certain function of guiding the airflow blown out of the air blowing port 4014, so that the airflow blown out of the air blowing port 4014 can blow up the dust on the surface to be cleaned better.

Furthermore, the rest of the floor brush opening 202 is provided with bristles 205, except the side of the floor brush opening 202 close to or at the air blowing port 4014. Thus, by providing the bristles 205, when the surface to be cleaned (such as the hair and skin of the pet) is cleaned, the hair of the pet can be combed.

The hand-held device 400 according to embodiments of the present disclosure has a better cleaning effect for the surface to be cleaned.

Other compositions (such a dust separating device) of the vacuum cleaner 100 according to embodiments of the present disclosure are known to those skilled in the related art, and will not be detailed herein.

Reference throughout this specification to "an embodiment," "some embodiments," "one embodiment", "another example," "an example," "a specific example," or "some examples," means that a particular feature, structure, material, or characteristic described in connection with the embodiment or example is included in at least one embodiment or example of the present disclosure. Thus, the appearances of the phrases such as "in some embodiments," "in one embodiment", "in an embodiment", "in another example," "in an example," "in a specific example," or "in some examples," in various places throughout this specification are not necessarily referring to the same embodiment or example of the present disclosure. Furthermore, the particular features, structures, materials, or characteristics may be combined in any suitable manner in one or more embodiments or examples.

Although explanatory embodiments have been shown and described, it would be appreciated by those skilled in the art that the above embodiments cannot be construed to limit the present disclosure, and changes, alternatives, and modifications can be made in the embodiments without departing from spirit, principles and scope of the present disclosure.

What is claimed is:

1. A vacuum cleaner, comprising a hand-held device, wherein the hand-held device comprises:

a housing;

a dust cup disposed in the housing and having a dust outlet in a bottom thereof; and an ash pouring plate disposed at a bottom of the housing, wherein the ash pouring plate is configured to be movable between an open position for opening the dust outlet and a closed position for closing the dust outlet;

wherein the dust cup comprises:

a first cyclone provided with an air intake channel, the air intake channel having a first air intake port and a first air outtake port;

a cyclone assembly comprising a plurality of second cyclones arranged in parallel along a circumferential direction of the first cyclone, two of the plurality of second cyclones defining a guiding channel therebetween, the guiding channel communicating with the first air outtake port and guiding the airflow to an outer periphery of the cyclone assembly along a tangent line of a circumferential wall of one second cyclone adjacent to the guiding channel, each second cyclone having an air inducing notch so that the airflow enters the second cyclone along a tangent direction, an air guiding pipe being provided in each second cyclone and spaced apart from an inner circumferential wall of the second cyclone, the air guiding pipe having an air guiding inlet and an air guiding outlet, and the air guiding inlet communicating with the air inducing notch; and a filter disposed along the outer periphery of the cyclone assembly, the airflow at the outer periphery of the cyclone assembly tangentially flowing into the second cyclone through the filter and the air inducing notch;

wherein the air guiding pipe is eccentrically disposed with respect to the second cyclone and located in an upper portion of the second cyclone; wherein the air guiding pipe extends in a vertical direction, and has a partition plate therein;

wherein the air guiding inlet is provided at a lower end of the air guiding pipe, and the air guiding outlet is provided at an upper end of the air guiding pipe;

wherein the filter is arranged around the cyclone assembly and has a relief opening therein, and the relief opening is opposed to the guiding channel;

wherein a connecting wall is connected to a first side of the air inducing notch of each second cyclone, in which the connecting wall is tangent to a side wall of the second cyclone, and an extending part extends out from a second side of the air inducing notch of the second cyclone, and the extending part and the connecting wall define a tangential air inducing channel therebetween;

wherein the extending part extends towards a corresponding connecting wall along a flowing direction of the airflow;

wherein an inner wall of an end of the air intake channel has a guiding surface configured to guide the airflow in the air intake channel to the guiding channel, wherein the first air outtake port is provided at the end of the air intake channel; and wherein the guiding surface is configured as an arc surface.

2. The vacuum cleaner according to claim 1, wherein a first end of the ash pouring plate is pivotably connected to the housing so that the ash pouring plate is rotatable between the open position and the closed position, and a second end of the ash pouring plate is configured to be separably fitted with the housing.

3. The vacuum cleaner according to claim 2, wherein the second end of the ash pouring plate is configured to be separably fitted with the housing via at least one fitting structure, and the fitting structure comprises:

a first fitting member disposed at the second end of the ash pouring plate; and a second fitting member disposed at the housing, wherein when the ash pouring plate is in the open position, the first fitting member is separated from the second fitting member; when the ash pouring plate is in the closed position, the first fitting member is fitted with the second fitting member.

4. The vacuum cleaner according to claim 3, wherein the first fitting member and the second fitting member are configured as snaps configured to be buckled with each other.

5. The vacuum cleaner according to claim 3, further comprising:

a press button disposed in the housing, wherein the second fitting member is disposed on the press button, and when the press button is pressed down, the second fitting member moves away from the first fitting member so as to be separated from the first fitting member.

6. The vacuum cleaner according to claim 5, wherein an elastic element is provided between the press button and the dust cup, and configured to constantly push the press button in a direction running away from a center of the housing.

7. The vacuum cleaner according to claim 6, wherein the elastic element is configured as a spring.

8. The vacuum cleaner according to claim 3, wherein two fitting structures are provided, and the two fitting structures are bilaterally symmetrical;

wherein the ash pouring plate extends in a front and rear direction, and a rear end of the ash pouring plate is pivotably connected to the housing; and wherein a sealing member is disposed between the ash pouring plate and the dust outlet so as to seal a gap between the ash pouring plate and the dust outlet.

9. The vacuum cleaner according to claim 1, wherein the guiding channel is configured to have a width gradually increased along a flowing direction of the airflow.

10. The vacuum cleaner according to claim 1, wherein each second cyclone has an opening in a bottom thereof.

11. The vacuum cleaner according to claim 1, wherein the filter is configured as a filter net or an insert having filtering holes.

12. The vacuum cleaner according to claim 1, further comprising:

a machine body; and a handle disposed on the machine body and pivotable between a first position and a second position, wherein the handle is located at a front side of the machine body when the handle is in the first position, and the handle is located at a rear side of the machine body when the handle is in the second position.

13. The vacuum cleaner according to claim 12, wherein at least one lock catch assembly is disposed between the machine body and the handle, and is configured to be movable between a locking position for locking the handle and a pivoting position for making the handle pivotable between the first position and the second position.

14. The vacuum cleaner according to claim 13, wherein each lock catch assembly comprises: a retainer disposed at the machine body; and a lock catch disposed at the handle and configured to be separably fitted with the retainer, wherein the lock catch is fitted with the retainer when the lock catch assembly is in the locking position, and the lock catch is separated from the retainer when the lock catch assembly is in the pivoting position.

15. The vacuum cleaner according to claim 14, wherein one of the lock catch and the retainer is provided with a fitting part, the other one of the lock catch and the retainer is provided with a fitting groove, and the fitting part is configured to be separably fitted with the fitting groove.

16. The vacuum cleaner according to claim 15, wherein the fitting part comprises a plurality of fitting teeth arranged in a circumferential direction of the one of the lock catch and the retainer and spaced from one another, the fitting groove comprises a plurality of sub fitting grooves arranged in a circumferential direction of the other one of the lock catch and the retainer and spaced from one another, and the plurality of fitting teeth is configured to be separably fitted with the plurality of sub fitting grooves.

17. The vacuum cleaner according to claim 15, wherein one of a surface of the lock catch and a surface of the retainer opposite to each other is provided with a guiding post, the other one of the surface of the lock catch and the surface of the retainer opposite to each other is provided with a guiding hole, and the fitting part is fitted with the fitting groove when the guiding post extends into the guiding hole.

18. The vacuum cleaner according to claim 17, wherein an end surface of a free end of the guiding post extends beyond a side surface of the fitting part adjacent to the retainer.

19. The vacuum cleaner according to claim 14, wherein the lock catch assembly further comprises a pull rod movably disposed in the handle, and the pull rod is fitted with the lock catch so that the lock catch is configured to be separably fitted with the retainer.

20. The vacuum cleaner according to claim 19, wherein the pull rod is disposed within the handle and movable between a fixing position and a releasing position, a pull block is provided at an end of the pull rod adjacent to a center of the machine body, one of the pull block and the machine body is provided with a fixing protrusion, the other one of the pull block and the machine body is provided with a fixing groove, when the pull rod is in the fixing position, the fixing protrusion is fitted with the fixing groove, so that the handle is immovable with respect to the machine body, when the pull rod is in the releasing position, the fixing protrusion is separated from the fixing groove, so that the handle is forward and backward rotatable with respect to the machine body.

21. The vacuum cleaner according to claim 20, wherein the lock catch is fitted with the retainer when the pull rod is in the fixing position, and the lock catch is separated from the retainer when the pull rod is in the releasing position.

22. The vacuum cleaner according to claim 20, wherein the pull rod is connected with the pull block via a connecting structure, and the connecting structure comprises: two ear plates disposed on the pull rod and spaced apart from each other, each ear plate having a connecting hole therein; and two connecting posts disposed on the pull block and spaced apart from each other, wherein the two connecting posts are configured to fit with the two connecting holes respectively so as to connect the pull block to the pull rod.

23. The vacuum cleaner according to claim 20, wherein the pull block is integral with the pull rod.

24. The vacuum cleaner according to claim 20, further comprising:

a second resetting member disposed within the handle and configured to constantly push the pull block towards the fixing position.

25. The vacuum cleaner according to claim 24, wherein the lock catch has a first inclined surface, the pull rod has a second inclined surface, and the second inclined surface is configured to fit with the first inclined surface so that the lock catch is configured to be separably fitted with the retainer;

wherein a positioning member is provided on an inner wall of the handle, and the lock catch is provided with a positioning groove configured to fit with the positioning member;

wherein two lock catch assemblies are provided and bilaterally symmetrical with respect to a center of a pivoting shaft;

wherein one of two lock catches of the two lock catch assemblies is provided with a circumferential position limiting protrusion, and the other one of the two lock catches of the two lock catch assemblies is provided with a circumferential position limiting groove;

wherein the handle is pivotably connected with the machine body via a pivoting shaft, and the lock catch assembly is penetrated by the pivoting shaft;

wherein the pivoting shaft comprises a threaded fastener and at least one nut connected to a free end of the threaded fastener;

wherein when the pull rod moves to the releasing position from the fixing position, the pull rod moves in a direction running away from the center of the machine body and along a length direction of the handle;

wherein when the pull rod is in the fixing position, the handle is in a substantially upright state with respect to the machine body; and wherein the pull rod is provided with a pull rod button, an opening is formed in the handle and the pull rod button extends out of the handle through the opening.

26. The vacuum cleaner according to claim 13, further comprising:

a first resetting member disposed between the retainer and the lock catch and configured to constantly push the lock catch in a direction running away from a center of the retainer; or a first resetting member disposed at a side of the lock catch away from the retainer and configured to constantly push the lock catch towards the retainer.

27. The vacuum cleaner according to claim 26, wherein the first resetting member is configured as a spring.

* * * * *